US011536531B1

(12) United States Patent
Geissele et al.

(10) Patent No.: US 11,536,531 B1
(45) Date of Patent: Dec. 27, 2022

(54) AMBIDEXTROUS FIREARM CONTROLS

(71) Applicant: WHG Properties, LLC, North Wales, PA (US)

(72) Inventors: William Geissele, Lower Gwynedd, PA (US); Frank Robinson, Schwenksville, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 0 days.

(21) Appl. No.: 17/457,581

(22) Filed: Dec. 3, 2021

(51) Int. Cl.
*F41A 35/06* (2006.01)

(52) U.S. Cl.
CPC ..... *F41A 35/06* (2013.01)

(58) Field of Classification Search
CPC ..... F41A 3/68; F41A 35/06; F41A 17/36
USPC ..... 89/138
See application file for complete search history.

(56) References Cited

U.S. PATENT DOCUMENTS

| | | | |
|---|---|---|---|
| 5,519,954 | A | 5/1996 | Garrett |
| 7,219,462 | B2 | 5/2007 | Finn |
| 7,574,823 | B2 | 8/2009 | Mayberry |
| 7,661,219 | B1 | 2/2010 | Knight, Jr. et al. |
| 7,798,045 | B1 | 9/2010 | Mayberry et al. |
| 7,810,270 | B2 | 10/2010 | Fitzpatrick et al. |
| 7,921,587 | B2 | 4/2011 | Mayberry |
| 8,261,652 | B2 | 9/2012 | Findlay |
| 8,359,966 | B1 | 1/2013 | Brotherton |
| 8,713,832 | B2 | 5/2014 | Troy et al. |
| 9,015,978 | B2 | 4/2015 | Troy et al. |
| 9,121,651 | B1 | 9/2015 | Huei |
| 9,194,638 | B2 | 11/2015 | Larson et al. |
| 9,372,043 | B2 | 6/2016 | Larson et al. |

(Continued)

FOREIGN PATENT DOCUMENTS

EP 2823249 B1 7/2016

OTHER PUBLICATIONS

Olgetree, Jimmy, Norgon Ambidextrous Magazine Release for the AR15, dated Dec. 2, 2019 [retrieved from Internet Oct. 4, 2021] https://rangehot.com/norgon-ambidextrous-magazine-release-ar15/ (5 pages).

(Continued)

*Primary Examiner* — Reginald S Tillman, Jr.
(74) *Attorney, Agent, or Firm* — Alston & Bird LLP

(57) ABSTRACT

Various embodiments are directed to ambidextrous firearm controls, including an ambidextrous bolt control assembly and/or ambidextrous magazine release and associated methods. The ambidextrous bolt control assembly may include a bolt catch configured to hingedly connect to a firearm to rotate between a disengaged position and an engaged position, the bolt catch may include a first bolt catch engagement button operable from a first side of the firearm and a first bolt catch release button operable from the first side of the firearm; an ambidextrous bolt catch engagement button operable from a second side of the firearm; and an ambidextrous bolt catch release button operable from the second side of the firearm; wherein the ambidextrous bolt catch engagement button and the ambidextrous bolt catch release button may each be separately movable relative to the firearm. The ambidextrous bolt catch assembly may further include an ambidextrous magazine release assembly.

23 Claims, 13 Drawing Sheets

(56) References Cited

U.S. PATENT DOCUMENTS

| | | | | |
|---|---|---|---|---|
| 9,417,020 | B2 | 8/2016 | McGinty | |
| 9,429,375 | B2 | 8/2016 | Desomma et al. | |
| 9,494,378 | B2 | 11/2016 | Gomez | |
| 9,541,339 | B2 | 1/2017 | Orne, III et al. | |
| 9,541,340 | B2 | 1/2017 | Fluhr et al. | |
| 9,593,897 | B2 | 3/2017 | Larson et al. | |
| 9,599,419 | B2 | 3/2017 | McGinty | |
| 9,651,328 | B1 | 5/2017 | Oglesby | |
| 9,958,223 | B1 | 5/2018 | McGinty | |
| 9,964,370 | B2 | 5/2018 | Orne, III et al. | |
| 9,989,326 | B2 | 6/2018 | Larson et al. | |
| 10,036,601 | B2 | 7/2018 | Desomma et al. | |
| 10,197,353 | B2 | 2/2019 | Lewis et al. | |
| 10,215,513 | B2 | 2/2019 | Cross | |
| 10,393,468 | B2 | 8/2019 | Maugham | |
| 10,415,913 | B2 | 9/2019 | Wyssen | |
| 10,677,548 | B2 | 6/2020 | Gibbens et al. | |
| 10,753,696 | B1 | 8/2020 | Christopher et al. | |
| 10,801,807 | B2 | 10/2020 | Desomma et al. | |
| 11,340,029 | B2 * | 5/2022 | Stenzel | F41A 35/06 |
| 11,385,008 | B2 * | 7/2022 | Markut | F41A 17/36 |
| 2006/0123683 | A1 | 6/2006 | Garrett et al. | |
| 2018/0372441 | A1 | 12/2018 | Zheng | |
| 2020/0309476 | A1 | 10/2020 | Gibbens et al. | |

OTHER PUBLICATIONS

Norgon Ambidextrous Magazine Release for the AR15, dated Dec. 2015 [retrieved from Internet Oct. 4, 2021] https://rangehot.com/wp-content/uploads/2015/12/IMG_0174-277x300.jpg (1 -page).

SIG Sauer M400: Always Reliable, dated Apr. 9, 2019 [retrieved from Internet Oct. 4, 2021] https://blog.gritrsports.com/sig-sauer-m400-always-reliable/ (9 pages).

SIG Sauer M400 ambidextrous magazine release, dated Apr. 2015 [retrieved from Internet Oct. 4, 2021] https://blog.gritrsports.com/wp-content/uploads/2015/04/IMG_2734.jpg (1 page).

Ambi Mag Release, 1911 Forum, dated between Dec. 26, 2018 and Dec. 29, 2018 [retrieved from Internet Oct. 4, 2021] https://www.1911forum.com/threads/ambi-mag-release.980940/ (10 pages).

AR15 ambidextrous magazine release, dated Dec. 26, 2018 [retrieved from Internet Oct. 4, 2021] https://i.imgur.com/CXqgMli.jpeg (1 page).

Primary Weapon Systems MK111 SBR ambidextrous magazine release, dated Dec. 26, 2018 [retrieved from Internet Oct. 4, 2021] https://imgur.com/HvqbfBF (8 pages).

* cited by examiner

AMBIDEXTROUS FIREARM CONTROLS

FIELD OF THE INVENTION

Various embodiments described herein relate generally to firearm controls. In particular, various embodiments are directed to ambidextrous firearm controls configured for operation from both lateral sides of a firearm.

BACKGROUND

Industrial and commercial applications may use firearms comprising ambidextrous firearm controls. In particular, a firearm comprising ambidextrous firearm controls may be used to enable user control of various firearm controls from either a left side or a right side of the firearm. Through applied effort, ingenuity, and innovation, Applicant has solved problems relating to ambidextrous firearm controls by developing solutions embodied in the present disclosure, which are described in detail below.

BRIEF SUMMARY

Various embodiments are directed to ambidextrous controls for a firearm. Various embodiments include, for example, an ambidextrous bolt control assembly and/or ambidextrous magazine release and methods of using the same. In various embodiments, an ambidextrous bolt control assembly may comprise a bolt catch configured to hingedly connect to a firearm to rotate between a disengaged position and an engaged position, the bolt catch comprising a first bolt catch engagement button operable from a first side of the firearm and a first bolt catch release button operable from the first side of the firearm, wherein the first bolt catch engagement button may be configured to, upon actuation thereof, cause the bolt catch to rotate in a first rotational direction towards the engaged position, and wherein the first bolt catch release button may be configured to, upon actuation thereof, cause the bolt catch to rotate in a second rotational direction towards the disengaged position; an ambidextrous bolt catch engagement button operable from a second side of the firearm and configured to, upon actuation thereof, cause the bolt catch to move in the first rotational direction; and an ambidextrous bolt catch release button operable from the second side of the firearm and configured to, upon actuation thereof, cause the bolt catch to move in the second rotational direction; wherein the ambidextrous bolt catch engagement button and the ambidextrous bolt catch release button may each be separately movable relative to the firearm.

In various embodiments, the ambidextrous bolt catch engagement button may be configured to cause the bolt catch to move in the first rotational direction by, upon actuation thereof, causing a first pushing element to move laterally toward the first side of the firearm and engage the bolt catch so as to exert a pushing force on the bolt catch and cause the bolt catch to rotate in the first rotational direction. In some embodiments, the bolt catch may further comprise an angled engagement interface oriented at least partially downwardly and at least partially towards a second side of the firearm; and the first pushing element may be configured to, upon actuation of the ambidextrous bolt catch engagement button, engage the bolt catch at the angled engagement interface so as to exert the pushing force on the angled engagement interface. In various embodiments, the ambidextrous bolt catch release button may be configured to cause the bolt catch to move in the second rotational direction by, upon actuation thereof, causing a second pushing element to move laterally toward the first side of the firearm and engage the bolt catch so as to exert a pushing force on the bolt catch and cause the bolt catch to rotate in the second rotational direction.

In some embodiments, the bolt catch may further comprise a third pushing element configured to contact the bolt catch and arranged such that in an instance in which the bolt catch is in the disengaged position, the third pushing element extends in an at least substantially lateral direction towards the second side of the firearm. In various embodiments, the second pushing element may be configured to, upon actuation of the ambidextrous bolt catch release button, engage the bolt catch at the third pushing element so as to exert the pushing force on the third pushing element, wherein the third pushing element is positioned to engage a surface of the bolt catch and cause the bolt catch to rotate in the second rotational direction. In some embodiments, the first bolt catch engagement button may be disposed at an end portion of an arm of the bolt catch; and the surface of the bolt catch may define at least a portion of the arm of the bolt catch, the surface being arranged on an opposing side of the arm relative to the first bolt catch engagement button. In various embodiments, the ambidextrous bolt catch assembly may be configured such that in an instance in which the bolt catch is in the disengaged position, the third pushing element is at least substantially coaxial with the second pushing element and separated from the second pushing element by a lateral gap extending therebetween the second pushing element and the third pushing element, wherein a spring is disposed between the second pushing element and the third pushing element. In some embodiments, the lateral gap may define a distance such that, in an instance in which the ambidextrous bolt catch release button is in a neutral position, the bolt catch is configured to rotate to the engaged position in response to actuation of the first bolt catch engagement button without the second pushing element contacting the third pushing element.

In various embodiments, the ambidextrous bolt catch engagement button and the ambidextrous bolt catch release button may each be hinged about a common axis extending in an at least substantially vertical direction. In various embodiments, the ambidextrous bolt catch engagement button and the ambidextrous bolt catch release button may be arranged in a vertically stacked configuration; and the ambidextrous bolt catch release button may be longer than the ambidextrous bolt catch engagement button and at least a portion of the ambidextrous bolt catch release button wraps around at least a portion of a distal end of the ambidextrous bolt catch engagement button such that both the ambidextrous bolt catch release button and the ambidextrous bolt catch engagement button are operable from a common vertical position along a height of the firearm.

In various embodiments, the ambidextrous bolt catch assembly may further comprise an ambidextrous magazine release assembly, the ambidextrous magazine release assembly comprising: a rod extending from a first rod end to a second rod end, wherein the rod is positioned in an at least substantially lateral direction between the first side of the firearm and the second side of the firearm, the second rod end being defined by a rod base; a lever arm extending from a first arm end to a second arm end and being positioned in an at least substantially longitudinal direction along the first side of the firearm, wherein the lever arm is configured to hingedly connect to the rod base, the lever arm comprising: a magazine engagement protrusion extending from the second arm end, the magazine engagement protrusion being configured to engage a magazine in an engaged position; and an ambidextrous magazine release button positioned at the first arm end, the ambidextrous magazine release button being operable from the first side of the firearm and configured to, upon actuation thereof, cause the magazine engagement protrusion to move in a rotational magazine release direction; wherein the lever arm is hingedly connected to the rod base at a vertical hinge pivot positioned along the lever arm between the magazine engagement protrusion and the ambidextrous magazine release button; a first magazine release button connected to the first rod end, the first magazine release button being operable from the second side of the firearm and configured to, upon actuation thereof, cause the magazine engagement protrusion to move in a lateral magazine release direction; a rod spring positioned between the first magazine release button and a portion of a lower receiver adjacent to the rod base and configured to bias the first magazine release button outwardly away from the first side; and a lever arm spring extending between the ambidextrous magazine release button and the rod base and configured to rotationally bias the ambidextrous magazine release button about the vertical hinge pivot and away from the rod base so as to bias the magazine engagement protrusion towards the magazine.

In various embodiments, the ambidextrous magazine release assembly may be configured such that, upon actuation of the ambidextrous magazine release button, the lever arm rotates about the vertical hinge pivot without causing the rod to move. Further, in various embodiments, the ambidextrous magazine release assembly may be configured such that, upon actuation of the first magazine release button, the rod base and the lever arm translate in an outward lateral direction away from the first side of the firearm without rotating about the vertical hinge pivot. In various embodiments, the first side of the firearm may comprise at least one raised lip element protruding in an outward lateral direction away from the first side of the firearm, the at least one raised lip element being configured to extend at least partially around a perimeter of the ambidextrous magazine release button. In various embodiments, each of the first bolt catch engagement button, the first bolt catch release button, and the ambidextrous magazine release button may be aligned in a vertically stacked configuration along the first side.

In various embodiments, the ambidextrous bolt catch assembly may further comprise a dust cover configured to hingedly connect to the second side of the firearm to move between an open position and a closed position, wherein the dust cover is configured such that, in an instance in which the dust cover is moved in an opening direction towards the open position, at least a portion of an exterior surface of the dust cover engages the ambidextrous bolt catch engagement button to facilitate actuation of the ambidextrous bolt catch engagement button. In some embodiments, the dust cover may be positioned to be movable from the closed position towards the open position without engaging the ambidextrous bolt catch release button.

Various embodiments are directed to a firearm comprising an ambidextrous bolt catch assembly that may include a bolt catch configured to hingedly connect to a firearm to rotate between a disengaged position and an engaged position, the bolt catch comprising a first bolt catch engagement button operable from a first side of the firearm and a first bolt catch release button operable from the first side of the firearm, wherein the first bolt catch engagement button is configured to, upon actuation thereof, cause the bolt catch to rotate in a first rotational direction towards the engaged position, and wherein the first bolt catch release button is configured to, upon actuation thereof, cause the bolt catch to rotate in a second rotational direction towards the disengaged position; an ambidextrous bolt catch engagement button operable from a second side of the firearm and configured to, upon actuation thereof, cause the bolt catch to move in the first rotational direction; and an ambidextrous bolt catch release button operable from the second side of the firearm and configured to, upon actuation thereof, cause the bolt catch to move in the second rotational direction; wherein the ambidextrous bolt catch engagement button and the ambidextrous bolt catch release button are each separately movable relative to the firearm.

Various embodiments are directed to an ambidextrous bolt catch assembly that may include: a bolt catch configured to hingedly connect to a firearm to rotate between a disengaged position and an engaged position, the bolt catch may include: a protrusion configured to engage a bolt of the firearm; and an angled engagement interface oriented at least partially downwardly and at least partially towards a second side of the firearm; a first bolt catch engagement button operable from a first side of the firearm configured to, upon actuation thereof, cause the bolt catch to rotate in a first rotational direction towards the engaged position; and an ambidextrous bolt catch engagement button operable from a second side of the firearm and configured to, upon actuation thereof, cause a first pushing element to move laterally toward the first side of the firearm and engage the angled engagement interface of the bolt catch to cause the bolt catch to rotate in the first rotational direction towards the engaged position.

In various embodiments, ambidextrous bolt catch assembly may further comprise an ambidextrous bolt catch release button operable from the second side of the firearm and configured to, upon actuation thereof, cause the bolt catch to move in a second rotational direction to the disengaged position, wherein the ambidextrous bolt catch release button causes the bolt catch to move in the second rotational direction by, upon actuation thereof, causing a second pushing element to move laterally toward the first side of the firearm and engage the bolt catch so as to exert a pushing force on the bolt catch and cause the bolt catch to rotate in the second rotational direction. In various embodiments, the angled engagement interface may comprise an interface angle of at least approximately 45 degrees.

Various embodiments are directed to a firearm comprising a ambidextrous bolt catch assembly that may include a bolt catch configured to hingedly connect to a firearm to rotate between a disengaged position and an engaged position, the bolt catch comprising: a protrusion configured to engage a bolt of the firearm; and an angled engagement interface oriented at least partially downwardly and at least partially towards a second side of the firearm; a first bolt catch engagement button operable from a first side of the firearm configured to, upon actuation thereof, cause the bolt catch to rotate in a first rotational direction towards the engaged position; and an ambidextrous bolt catch engagement button operable from a second side of the firearm and configured to, upon actuation thereof, cause a first pushing element to move laterally toward the first side of the firearm and engage the angled engagement interface of the bolt catch to cause the bolt catch to rotate in the first rotational direction towards the engaged position.

BRIEF DESCRIPTION OF THE DRAWINGS

Reference will now be made to the accompanying drawings, which are not necessarily drawn to scale, and wherein.

DETAILED DESCRIPTION

Figure 1:
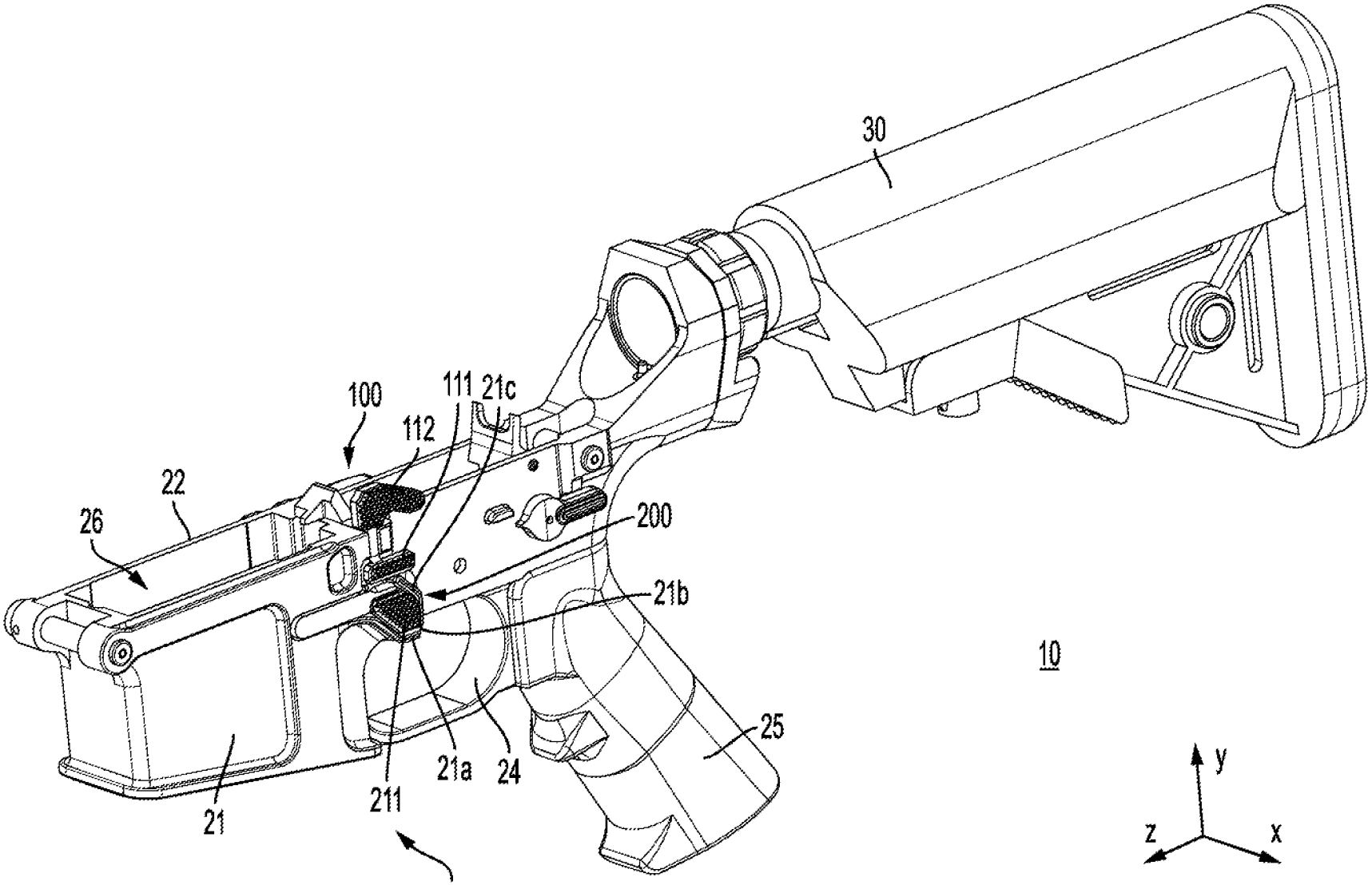
FIG. 1 illustrates a perspective view of a portion of an exemplary firearm including ambidextrous firearm controls in accordance with various embodiments.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are illustrated below, the disclosed assemblies, systems, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary" embodiment is not necessarily preferred or advantageous over other implementations.

As used herein, directional terms used to describe a component, configuration, action, position, direction, and/or the like (e.g., "downwardly," "an upward vertical direction," and the like) are meant to be interpreted relative to a hypothetical firearm with its barrel pointed towards the horizon in a normal shooting position, but the terms are not to be interpreted as requiring the firearm to be in this orientation at any particular time (i.e., a firearm with a normally downwardly-oriented angled surface would still have the angled surface oriented "downwardly" relative to the firearm even when the firearm is turned upside down).

Various firearms (e.g., an AR-15 platform rifle) utilize semi-automatic or fully automatic bolt mechanisms, each configured to guide a round from a magazine to the chamber. The bolt moves between a rear position and a front position as the firearm fires sequential rounds with a spring operating to urge the bolt towards the front position and forces exerted by the expanding propellant gas from a fired cartridge urging the bold towards the rear position. In some embodiments of the present disclosure, firearms may include a bolt catch mechanism configured to catch and hold the bolt in the rear (i.e. open) position after the last round of a magazine has been fired and/or when the mechanism is manually locked by a user in order to allow the user to view the open chamber for inspection purposes, storage purposes, travel purposes, to confirm the contents within the chamber, or otherwise. The bolt catch may be engaged with and released from engagement with the bolt via various assemblies. For example, various bolt catch engagement mechanisms according to embodiments of the present disclosure may be manually operated by a user pressing a button located on one side (e.g., the left side) of a firearm, which may cause the bolt catch to be actuated into an engaged position to hold a retracted bolt in the rear, open chamber position. Similarly, various bolt catch release mechanisms according to embodiments of the present disclosure may be manually operated by the user in order to move the bolt catch from the engaged position to a disengaged position to release the bolt from the rear, open position to travel back into a front, closed position. For example, various bolt release mechanisms may be manually engaged by a user pressing a button located on one side (e.g., the left side) of the firearm. Further, various firearms according to embodiments of the present disclosure may include a magazine release mechanism that may be manually operated by a user to disengage a magazine catch that is securing the magazine in a locked configuration for operation of the firearm to release the magazine. For example, various magazine release mechanisms may be manually operated by a user pressing a button located on one side (e.g., the right side) of a firearm in order to cause the magazine catch to disengage the magazine such that the emptied magazine may be removed from the firearm for replacement.

Such firearm controls may be operated from a particular side of the firearm in accordance with the location of the respective mechanism, which may be better suited to various preferences of a right-handed user by promoting accessibility, ergonomic considerations, and ease-of-use of the various firearm control components for a user having right-handed tendencies (e.g., right-handed users may find certain button locations easier to access). Such firearms may be defined by rigid control operations that, given the wide array of use cases and operational parameters often required by the practical circumstances in which the firearms are utilized, can produce in operational inefficiencies resulting from a rigid control configuration that causes an operation of the control mechanisms of the firearm to be inconvenient and/or inefficient for a user having unique ergonomic preferences or a user operating the firearm under one or more restrictive practical circumstances that limit the physical space and/or time the user has to execute the control operation of the firearm. These problems may be exacerbated by the fact that semi-automatic or fully automatic firearms may often be utilized in circumstances wherein operational speed and efficiency are critical to the safety of the user. In particular, these problems may be further exacerbated for left-handed users that may experience a decrease in operational efficiency (e.g., speed, effectiveness, and/or the like) or even a physical inability to effectively control the firearm when utilizing rigid control configurations configured about a single side of the firearm for a right-handed user.

The present disclosure relates generally to ambidextrous firearm controls that enable the user of a firearm to control one or more of a bolt catch engagement, a bolt catch release, and the magazine release from either a left side or a right side of the firearm without changing the manner in which the bolt or magazine function. Each of the ambidextrous firearm controls as described herein is beneficial when compared to firearm controls that are limited to being operable from a single side of the firearm or are otherwise defined by rigid control configurations that do not facilitate efficient use for both left-handed and right-handed users. Further, each of the ambidextrous firearm controls as described herein is beneficial when compared to firearm controls that are not configured for ambidextrous control of a bolt catch engagement mechanism, a bolt catch release mechanism, and/or a magazine release mechanism. Various ambidextrous bolt catch control assemblies described herein promote accessibility, ergonomic considerations, and ease-of-use for both left-handed users and right-handed users so as to minimize operational inefficiencies (e.g., decreases in speed, effectiveness, and/or the like) associated with the firearm control operations that may be caused by user-specific preferences or specific circumstantial parameters associated with the practical execution of a control operation.

Figure 2:
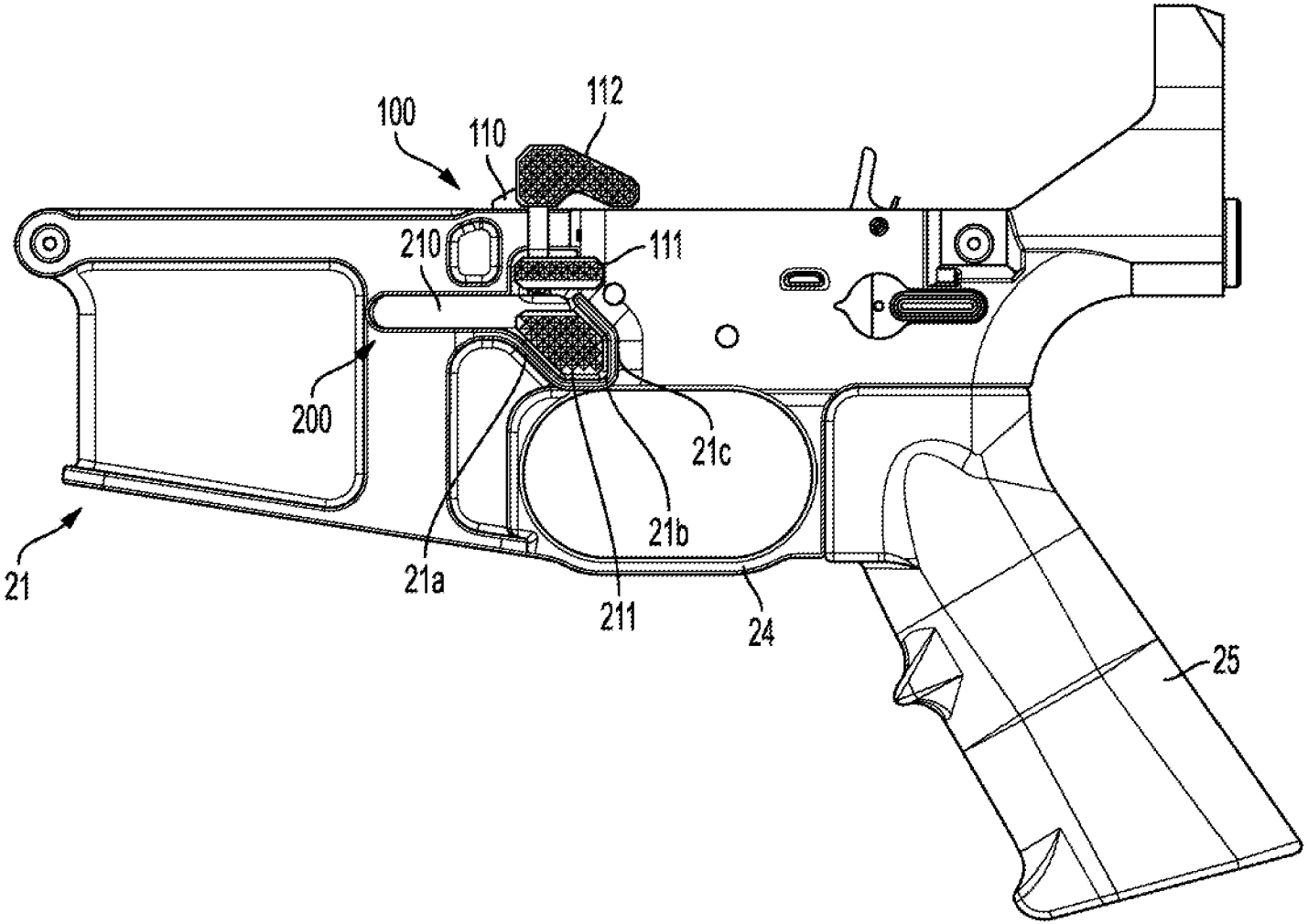
FIG. 2 illustrates a left-side view of a portion of an exemplary firearm including ambidextrous firearm controls in accordance with various embodiments.
Figure 3:
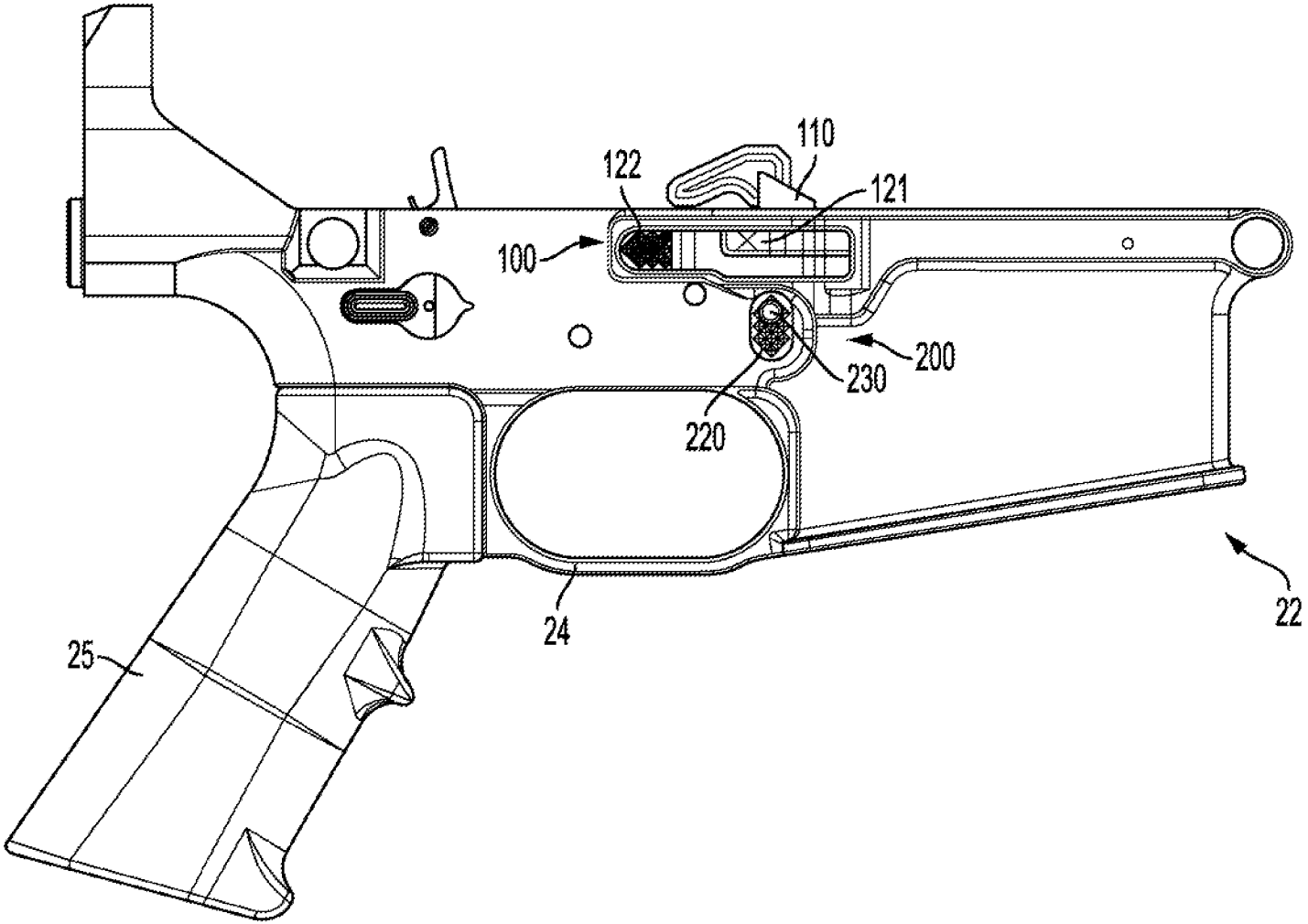
FIG. 3 illustrates a right-side view of a portion of an exemplary firearm including ambidextrous firearm controls in accordance with various embodiments.

FIGS. 1-3 illustrate various views of an exemplary firearm including ambidextrous firearm controls in accordance with various embodiments of the present disclosure. In particular, FIG. 1, FIG. 2, and FIG. 3 illustrate a perspective view, a left view, and a right view, respectively, of an exemplary firearm 10 comprising ambidextrous firearm controls including an ambidextrous bolt catch assembly 100 and an ambidextrous magazine release assembly 200, in accordance with various embodiments. In various embodiments, an exemplary firearm 10 may comprise a semi-automatic or fully automatic rifle, such as, for example, an AR-15 platform weapon. As illustrated, an exemplary firearm 10 may be defined at least in part by a length extending in a longitudinal direction (e.g., in the depicted z-direction), a width extending in a lateral direction (e.g., in the depicted x-direction), and a length extending in a vertical direction (e.g., in the depicted y-direction). In various embodiments, an exemplary firearm 10 may include a buttstock 30 positioned about a rear portion of the firearm 10 and lower receiver or body 20, including a pistol grip 25, a trigger 24, a magazine well 26. An upper receiver (shown in FIGS. 8A-8B) may house the bolt and bolt carrier group components.

In various embodiments, the body 20 may extend along a width of the firearm 10 between a first side 21 defined by a first lateral end of the firearm 10 and a second side 22 defined by a second lateral end of the firearm 10. As illustrated, the first side 21 of the firearm 10 may be a left side, as the first side 21 is positioned on a shooter's left from the perspective of a shooter positioned behind the firearm with barrel pointed towards the horizon in a normal shooting position. Further, as described herein, the second side 22 of the firearm of the firearm 10 may be a right side, as the second side 22 is positioned on a shooter's right from the perspective of a shooter positioned behind the firearm 10 with the barrel pointed towards the horizon in a normal shooting position. As used herein, the orientation of the ambidextrous bolt catch assembly 100 and/or the orientation of the ambidextrous magazine release assembly 200 may be reversed from side to side, either by mirroring or by rotationally repositioning the respective components. As used herein, the "first side" and "second side" are shown in the Figures with a given orientation relative to the firearm for example purposes; however, it should be understood that these terms are not limiting and the sides may be interchanged without specifying a particular left or right side of the firearm unless expressly required herein (e.g., the "first side" may be either a right or left side of the firearm, and likewise the "second side" may be either a right or left side of the firearm).

As illustrated in FIGS. 2 and 3, an exemplary firearm 10 may comprise ambidextrous firearm controls positioned along both the first side 21 and the second side 22 of the firearm 10 such that one or more control operations of the firearm 10, such as, for example, a bolt catch engagement operation, a bolt catch release operation, and/or a magazine release operation, may be executed via user actuation from either a left side or a right side of the firearm 10. For example, as illustrated in FIG. 2, an exemplary ambidextrous bolt catch assembly 100 may comprise a first bolt catch engagement button 111 positioned along the first side 21 of the firearm 10 and operable from the first side 21 such that a user may actuate the first bolt catch engagement button 111 from the first side 21 to cause a bolt catch 110 to rotate towards an engaged position, as described herein. For example, the first bolt catch engagement button 111 may be actuated to execute at least a portion of a bolt catch engagement operation. Further, an exemplary ambidextrous bolt catch assembly 100 may comprise a first bolt catch release button 112 positioned along the first side 21 of the firearm 10 and operable from the first side 21 such that a user may actuate the first bolt catch release button 112 from the first side 21 to cause a bolt catch to rotate towards a disengaged position, as described herein. For example, the first bolt catch release button 112 may be actuated to execute at least a portion of a bolt catch release operation. Further still, an exemplary ambidextrous magazine release assembly 200 may comprise an ambidextrous magazine release button 211 positioned along the first side 21 of the firearm 10 and operable from the first side 21 such that a user may actuate the ambidextrous magazine release button 211 from the first side 21 to cause a magazine engagement protrusion to move in a rotational magazine release direction, as described herein. For example, the ambidextrous magazine release button 211 may be actuated to execute at least a portion of a magazine release operation.

In various embodiments, as illustrated in FIG. 2, the first bolt catch engagement button 111, the first bolt catch release button 112, and the ambidextrous magazine release button 211 may each be aligned in a vertically stacked configuration along the first side 21, such that at least a portion of each of the first bolt catch engagement button 111, the first bolt catch release button 112, and the ambidextrous magazine release button 211 is disposed along the first side 21 of the firearm 10 within a common front-to-back (e.g., a y-z plane) and/or left-to-right (e.g., an x-y) vertical plane. Further, in various embodiments, the first side 21 of the firearm 10 may comprise at least one raised lip element 21*a* protruding in an outward lateral direction away from the first side 21 of the firearm 10 (e.g., in the positive x-direction). In various embodiments, the one or more raised lip element 21*a* may be configured to extend at least partially around a perimeter of a lever arm 210 and/or ambidextrous magazine release button 211 of the ambidextrous magazine release assembly, such that the at least a portion of the lever arm 210 and/or ambidextrous magazine release button 211 is at least substantially flush with the raised lip element 21*a*, such that the raised lip element 21*a* is laterally aligned with or sits proud of the portion of the lever arm 210 and/or ambidextrous magazine release button 211. In the embodiment depicted in FIGS. 1-2, the raised lip 21*a* terminates near a lower rear corner of the ambidextrous magazine release button 211, and a lower lip 21*c* continues around a second portion of the ambidextrous magazine release button 211, such that the user is able to rest their finger on the button 211 from the rear without being hindered by the raised lip 21*a*. With continued reference to FIG. 2, the ambidextrous magazine release button 211 may extend at least partially downwardly (e.g., along the y-axis) relative to the rest of the lever 210 and the magazine engagement protrusion 212 and/or at least partially rearwardly (e.g., along the z-axis) such that the magazine release button is positioned closer to the trigger guard and the button provides a larger actuation surface than would otherwise fit on the lever 210, while also allowing clearance and ease of differentiation between the ambidextrous magazine release button 221 and the remaining buttons adjacent thereto.

As illustrated in FIG. 3, an exemplary ambidextrous bolt catch assembly may comprise an ambidextrous bolt catch engagement button 121 positioned along the second side 22 of the firearm 10 and operable from the second side 22 such that a user may actuate the ambidextrous bolt catch engagement button 121 from the second side 22 to cause a bolt catch to rotate towards a engaged position, as described herein. For example, the ambidextrous bolt catch engagement button 121 may be actuated to execute at least a portion of a bolt catch engagement operation (e.g., when the bolt is manually retracted to the rear by a user). Further, an exemplary ambidextrous bolt catch assembly may comprise an ambidextrous bolt catch release button 122 positioned along the second side 22 of the firearm 10 and operable from the second side 22 such that a user may actuate the ambidextrous bolt catch release button 122 from the second side 22 to cause a bolt catch to rotate towards a disengaged position, as described herein. For example, the ambidextrous bolt catch release button 122 may be actuated to execute at least a portion of a bolt catch release operation (e.g., to release the bolt from the rear position to return to a forward, closed position). Further still, an exemplary ambidextrous magazine release assembly may comprise a first magazine release button 220 positioned along the second side 22 of the firearm 10 and operable from the second side 22 such that a user may actuate the first magazine release button 220 from the second side 22 to cause a magazine engagement protrusion to translate laterally to release the magazine, as described herein. For example, the first magazine release button 220 may be actuated to execute at least a portion of a magazine release operation.

In various embodiments, as shown in FIG. 3, the ambidextrous bolt catch engagement button 121, the ambidextrous bolt catch release button 122, and the first magazine release button 220 may each be disposed along the second side 22 of the firearm 10 within a common vertical plane (e.g., a y-z plane). Further, in various embodiments, in various embodiments, the length of the ambidextrous bolt catch release button 122 (e.g., the distance between the user-actuatable portion and the hinge point) may be at least greater than the length of the ambidextrous bolt catch engagement button 121, and at least a portion of the ambidextrous bolt catch release button 122, such as, for example, at a distal end, wraps around a respective distal end of the ambidextrous bolt catch engagement button 121 such that both the ambidextrous bolt catch release button 122 and the ambidextrous bolt catch engagement button 121 are operable from a common vertical position along the height of the second side 22 of the firearm 10 (e.g., positioned along the same horizontal plane). Further, at least a portion of a perimeter of the ambidextrous bolt catch release button 122 may be configured to correspond to an exterior profile of an adjacent portion of the distal end of the ambidextrous bolt catch engagement button 121, such as shown in FIG. 3, such that the at least a portion of the perimeter of the ambidextrous bolt catch release button 122 at least partially extends around the distal end of the ambidextrous bolt catch engagement button 121. For example, in the depicted embodiment, the ambidextrous bolt catch engagement button 121 is disposed within a recess formed in a top portion of an arm of the ambidextrous bolt catch release button. In some embodiments, the ambidextrous bolt catch release button 122 and the first bolt catch release button 112 may be larger than their engagement button counterparts.

Figure 4A:
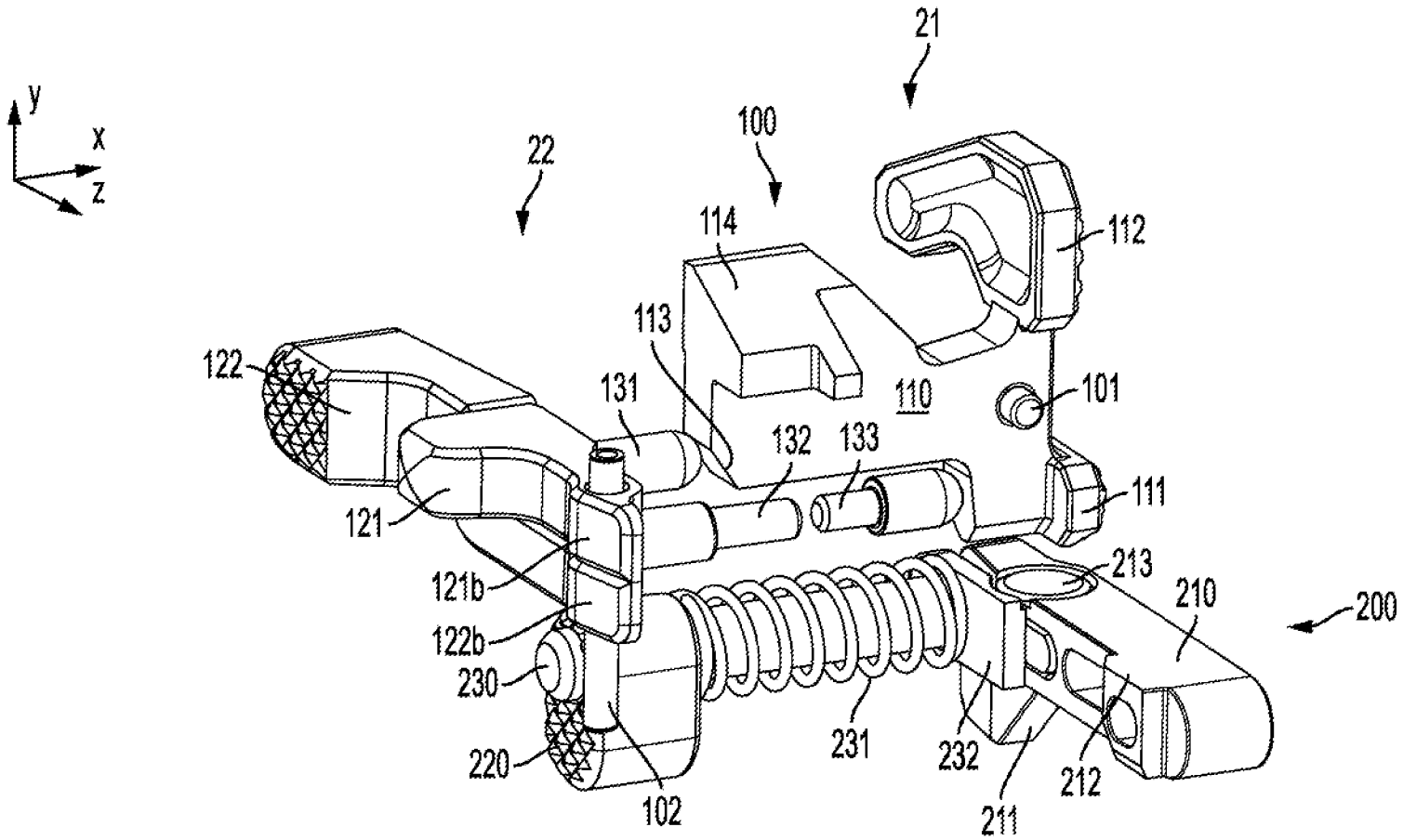
FIGS. 4A-4B illustrate various views of exemplary ambidextrous rifle controls in accordance with various embodiments.
Figure 4B:
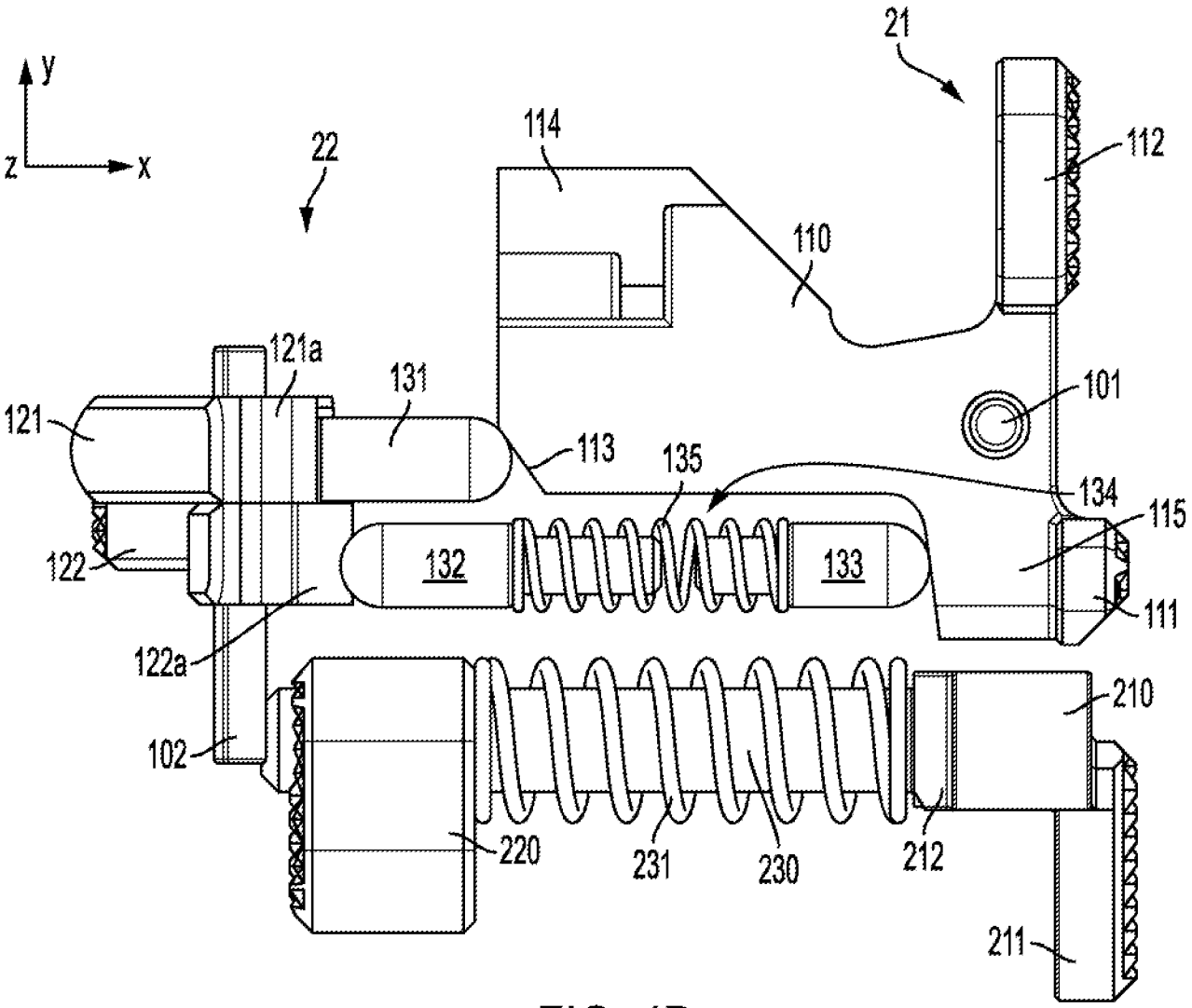

FIGS. 4A and 4B illustrate various views of exemplary ambidextrous rifle controls in accordance with various embodiments with the receiver elements removed for ease of visibility. FIG. 4A and FIG. 4B illustrate a perspective view and a front view, respectively, of exemplary ambidextrous rifle controls in accordance an example embodiment, including an ambidextrous bolt catch assembly 100 and an ambidextrous magazine control assembly 200. In various embodiments, as illustrated in FIGS. 4A and 4B, ambidextrous rifle controls may comprise an ambidextrous bolt catch assembly 100. An ambidextrous bolt catch assembly 100 may comprise a bolt catch 110 configured to hingedly connect to a firearm to rotate between a disengaged position and an engaged position. For example, the bolt catch 110 may be configured such that in an instance in which that bolt catch is in an engaged position, at least a portion of the bolt catch 110 may engage and/or be physically engaged by the firearm bolt such that the bolt catch 110 maintains the firearm bolt in a locked position (e.g., via a protrusion 114 contacting a portion of the bolt or another component of the bolt carrier group). In various embodiments, the bolt catch 110 may be hinged about an at least substantially horizontal axis extending in a longitudinal direction of the firearm, such as, for example, in a z-direction, as shown. For example, in various embodiments, the bolt catch 110 may be hingedly connected to the firearm via a hinge pin 101 extending through the bolt catch 110 in a longitudinal direction (e.g., along the length of the firearm in the z-direction) such that the bolt catch 110 rotates about the bolt catch hinge pin 101 between an engaged position and disengaged position in a first rotational direction towards the engaged position or in a second rotational direction towards the disengaged position. In such an exemplary configuration, both the first and second rotational directions may be defined within a vertical plane that extends in a lateral direction (e.g., in the x-y plane, rotationally about the z-axis). In various embodiments, the bolt catch hinge pin 101 may be positioned at or closer to a lateral side of the firearm, such as, for example, the left side of the firearm.

In various embodiments, a bolt catch 110 may comprise a first bolt catch engagement button 111 operable from a first side 21 of the firearm. In various embodiments, the first side 21 of the firearm from which the first bolt catch engagement button 111 is operable may be defined by the lateral side of the firearm (e.g., left side, right side) along which the bolt catch hinge pin 101 extends. For example, the first bolt catch engagement button 111 may be operable from a first side 21 of the firearm such that a user of the firearm may access the first bolt catch engagement button 111 from the first side 21 of the firearm and press the first bolt catch engagement button 111 in an inward direction into the first side 21 (e.g., left side) of the firearm, clockwise about the hinge pin 101 relative to the orientation of FIG. 4B. In various embodiments, the first bolt catch engagement button 111 may be integral with (e.g., as a single piece) or rigidly secured to the bolt catch 110 such that actuation first bolt catch engagement button 111 may cause the bolt catch 110 to rotate in the first rotational direction (e.g., in a clockwise direction about the bolt catch hinge pin 101 relative to the orientation of FIG. 4B) towards the engaged position, as described in further detail herein. For example, as illustrated, the first bolt catch engagement button 111 may be integral with or rigidly secured to a bottom portion of the bolt catch 110 such that actuation thereof from the left side of the firearm may cause the bolt catch 110 to rotate about the bolt catch hinge pin 101 towards the engaged position. For example, in various embodiments, the first bolt catch engagement button 111 may be disposed at an end portion of an arm 115 defined at a bottom portion of the bolt catch 110.

As described herein, the first bolt catch engagement button 111 may have a neutral position defined in an instance in which the bolt catch 110 is arranged in a disengaged position as shown in FIGS. 4A-4B. In the neutral position the first bolt catch engagement button 111 may be aligned with, and in some embodiments at least substantially flush with, the corresponding lateral side of the firearm from which it is operable. Further, in an exemplary circumstance wherein the bolt catch 110 is arranged in an engaged position, the first bolt catch engagement button 111 may be compressed into the corresponding lateral side of the firearm from which it is operable (e.g., the left side) in an at least partially inward direction, such that at least a portion of the first bolt catch engagement button 111 is disposed in a recess of the body 20.

In various embodiments, a bolt catch 110 may further comprise a first bolt catch release button 112 operable from the same side of the firearm as the first bolt catch engagement button 111. For example, as described above, a first side 21 of the firearm from which the first bolt catch release button 112 is operable may be defined by the lateral side of the firearm (e.g., left side or right side from the perspective of the shooter) along which the bolt catch hinge pin 101 may extend (e.g., the bolt catch hinge pin may be closer to one side than another in some embodiments). For example, the first bolt catch release button 112 may be operable from the first side 21 of the firearm such that a user of the firearm may access the first bolt catch release button 112 from the first side 21 of the firearm and press the first bolt catch release button 112 in an inward direction into the first side 21 (e.g., the left side for the shooter) of the firearm. In various embodiments, the first bolt catch release button 112 may be integral with or rigidly secured to the bolt catch 110 such that actuation first bolt catch release button 112 may cause the bolt catch 110 to rotate in a second rotational direction (e.g., in a counter-clockwise direction about the bolt catch hinge pin 101 relative to the orientation of FIG. 4B) towards the disengaged position, as described in further detail herein. For example, as illustrated, the first bolt catch release button 112 may be integral with or rigidly secured to a top portion of the bolt catch 110 opposite the first bolt catch engagement button 111 such that actuation of the first bolt catch release button 112 from the left side of the firearm may cause the bolt catch 110 to rotate in a counter-clockwise direction relative to the orientation of FIG. 4B about the bolt catch hinge pin 101 towards the disengaged position.

As described herein, the first bolt catch release button 112 may have a neutral position defined in an instance in which the bolt catch 110 is arranged in a disengaged position as shown in FIGS. 4A-4B. In the neutral position, the first bolt catch release button 112 may be aligned with, and in some embodiments at least substantially flush with, the corresponding lateral side of the firearm from which it is operable. Further, in an exemplary circumstance wherein the bolt catch 110 is arranged in an engaged position, the first bolt catch release button 112 may be configured so as to at least partially extend away from the corresponding lateral side of the firearm from which it is operable (e.g., the left side) in an at least partially outward direction. In various embodiments, wherein both the first bolt catch release button 112 and the first bolt catch engagement button 111 are integral with or rigidly secured to respective portions of the bolt catch 110, actuation of the first bolt catch release button 112 may cause a corresponding movement of the first bolt catch engagement button 111 towards a neutral position (e.g., if in a compressed position). Further, in such an exemplary circumstance, actuation of the first bolt catch engagement button 111 may cause a corresponding movement of the first bolt catch release button 112 towards an extended position away from the side of the firearm (e.g., from a neutral position).

In various embodiments, the bolt catch 110 may further comprise an angled engagement interface 113 configured to facilitate the rotation of the bolt catch 110 in the first rotational direction towards the engaged position based at least in part on an actuation of an ambidextrous bolt catch engagement button 121, as described herein. In various embodiments, an angled engagement interface 113 may be a surface of the bolt catch 110 that is oriented at least partially downwardly and at least partially towards a second side 22 of the firearm (e.g., the right side of the firearm and the left side in the view of FIG. 4B). For example, in some embodiments, the second side 22 of the firearm may be defined by an opposite lateral side of the firearm relative to the lateral side along which the bolt catch 110 is hinged (e.g., via a hinge pin 101), and the assemblies may be positioned on either side of the firearm. As described in further detail herein, the angled engagement interface 113 of the bolt catch 110 may be configured to be engaged by an ambidextrous bolt catch engagement button 121 and/or a pushing element (e.g., a first pushing element 131) engaged with an interior surface 121*a* thereof. In some embodiments, the angled engagement interface 113 may be configured such that upon actuation of the ambidextrous bolt catch engagement button 121 from the second side 22 of the firearm and movement of the bolt catch engagement button and/or translation of the first pushing element 131 in a lateral direction (e.g., along the x-axis) towards the first side 21 of the firearm, the angled engagement interface 113 may receive a pushing force from the ambidextrous bolt catch engagement button 121 and/or first pushing element 131. The angular configuration of the angled engagement interface 113 may cause the lateral pushing force to impart a non-lateral torque and a moment on the bolt catch 110 that may cause the bolt catch 110 to rotate in the first rotational direction towards the engaged position. In some embodiments, the first pushing element 131 may include a curved, domed, or other angled surface configured to further facilitate the non-lateral torque and moment in response to the lateral pushing force. The angled engagement interface 113 may be arranged in an at least partially downward-facing configuration defined by an interface angle relative to horizontal. For example, the angled engagement interface 113 may embody a chamfer edge arranged at a second-side, bottom portion of the bolt catch 110 and defined at least in part by an interface angle between the angled engagement interface 113 and an adjacent surface of the bottom portion of the bolt catch 110. For example, in various embodiments, the angled engagement interface 113 may be defined at least in part by an interface angle of at least substantially between 40 degrees and 50 degrees relative to an adjacent surface of the bottom portion of the bolt catch 110 and/or horizontal when the firearm is in a neutral firing position.

In various embodiments, an ambidextrous bolt catch assembly 100 may comprise the ambidextrous bolt catch engagement button 121 operable from the second side 22 of the firearm and configured to, upon actuation thereof, cause the bolt catch 110 to move in the first rotational direction towards the engaged position. In various embodiments, the second side 22 of the firearm from which the ambidextrous bolt catch engagement button 121 is operable may be the opposite lateral side of the first side 21 from which the first bolt catch engagement button 111 is operable. For example, the ambidextrous bolt catch engagement button 121 may be operable from the second side 22 of the firearm (e.g., the right side in the embodiment shown in FIGS. 1-3) such that a user of the firearm may access the ambidextrous bolt catch engagement button 121 from the second side 22 of the firearm and press the ambidextrous bolt catch engagement button 121 in an inward direction into the second side 22 of the firearm. Accordingly, as described herein, the ambidextrous bolt catch assembly 100 may be configured such that the bolt catch 110 may be moved towards the engaged position upon actuation of either the first bolt catch engagement button 111 operable from the first side 21 of the firearm or the ambidextrous bolt catch engagement button 121 operable from the second side 22 of the firearm.

In various embodiments, the ambidextrous bolt catch engagement button 121 may be hingedly connected to the firearm via an ambidextrous hinge pin 102 extending through a proximal end (e.g., opposite a knurled or otherwise actuatable button end) of the ambidextrous bolt catch engagement button 121 in a vertical direction (e.g., in the y-direction). In various embodiments, the ambidextrous bolt catch engagement button 121 may be defined at least in part by a length that extends in a longitudinal direction along the length of the firearm from the proximal end hinged at the ambidextrous hinge pin 102 to a distal end extending away therefrom along the second side 22 of the firearm toward a rear portion of the firearm (e.g., in the negative z-direction). In some embodiments, the ambidextrous bolt catch engagement button 121 and/or the ambidextrous bolt catch release button 122 may include a tab at the proximal end (e.g., tabs 121*b*, 122*b*), farther forward from and on an opposite side of the hinge pin 102 from the distal, button end of each respective button, such that the tab is configured to limit the range of motion of the buttons by contacting the body 20 to prevent them from rotating outwards past their neutral positions. For example, the ambidextrous bolt catch engagement button 121 may be configured such that a neutral position thereof is defined by at least a portion of the length of the ambidextrous bolt catch engagement button 121 extending parallel to the second side 22 of the firearm. Further, actuation of the ambidextrous bolt catch engagement button 121 may result in at least a portion of the ambidextrous bolt catch engagement button 121 being compressed (e.g., via the hinged motion about a central axis of the ambidextrous hinge pin 102) into second side 22 of the firearm (e.g., the right side) in an at least partially inward direction (e.g., into a recess in the second side 22 of the body 20). As described in further detail herein, the ambidextrous bolt catch engagement button 121 may be operable from the second side 22 of the firearm (e.g., the right side relative to the shooter) such that a user of the firearm may press an outward-facing surface of ambidextrous bolt catch engagement button 121 in an at least partially inward direction into the second side 22 of the firearm (e.g., in a positive x-direction). In some embodiments, the force of the angled surface 113 on the ambidextrous engagement button 121 and/or pushing element 131 may urge the ambidextrous engagement button 121 back to the neutral position at least when the bolt catch 110 is in the disengaged position.

In various embodiments, the ambidextrous bolt catch engagement button 121 may comprise an interior surface 121*a* defined by an inward-facing surface of the ambidextrous bolt catch engagement button 121 that is configured to, upon actuation of the ambidextrous bolt catch engagement button 121, move at least partially towards the first side 21 of the firearm. For example, the ambidextrous bolt catch engagement button 121 may be configured such that actuation thereof causes the interior surface 121*a* to move in a direction at least partially towards the bolt catch 110. As illustrated, in various embodiments, the ambidextrous bolt catch assembly 100 may comprise a first pushing element 131 configured to engage the interior surface 121*a* of the ambidextrous bolt catch engagement button 121 and extend at least partially between the interior surface 121*a* and the bolt catch 110. In various embodiments, the first pushing element 131 may be in contact with and movable by the interior surface 121*a* of the ambidextrous bolt catch engagement button 121. In various embodiments, the first pushing element 131 may define a physically distinct component arranged at least substantially adjacent the ambidextrous bolt catch engagement button 121 so as to abut the interior surface 121*a* thereof. For example, the first pushing element 131 may comprise a pin having an at least substantially rigid linear configuration. In various embodiments, the first pushing element 131 may be disposed in a channel of the body 20 between the bolt catch 110 and the ambidextrous bolt catch engagement button 121.

In various embodiments, the first pushing element 131 may be configured such that, upon activation of the ambidextrous bolt catch engagement button 121, the interior surface 121*a* may engage the first pushing element 131 so as to cause the first pushing element 131 to move in a linear direction (e.g., in a positive x-direction) towards the bolt catch 110. As described in further detail herein, the first pushing element 131 may be configured to, upon actuation of the ambidextrous bolt catch engagement button 121, laterally translate towards the bolt catch 110 so as to engage the bolt catch 110 and apply a pushing force to at least one surface of the bolt catch 110 (e.g., the angled engagement interface 113), thereby causing the bolt catch 110 to rotate in the first rotational direction towards the engaged position. For example, in various embodiments, the first pushing element 131 may be configured to engage the bolt catch 110 at the angled engagement interface 113 so as to exert the pushing force on the angled engagement interface 113 to move the bolt catch 110 into an engaged position (e.g., via rotation about hinge pin 101), as described herein.

In various embodiments, an ambidextrous bolt catch assembly 100 may further comprise an ambidextrous bolt catch release button 122 operable from a second side 22 of the firearm and configured to, upon actuation thereof, cause the bolt catch 110 to move in the second rotational direction towards a disengaged position. In various embodiments, the second side 22 of the firearm from which the ambidextrous bolt catch release button 122 is operable may be the opposite lateral side of the first side 21 from which the first bolt catch release button 112 is operable. For example, the ambidextrous bolt catch release button 122 may be operable from the second side 22 of the firearm (e.g., the right side) such that a user of the firearm may access the ambidextrous bolt catch release button 122 from the second side 22 of the firearm and press the ambidextrous bolt catch release button 122 in an inward direction into the second side 22 (e.g., into a recess in the right side of the body 20) of the firearm. Accordingly, as described herein, the ambidextrous bolt catch assembly 100 may be configured such that the bolt catch 110 may be reconfigured towards the engaged position upon actuation of either the first bolt catch release button 112 operable from the first side 21 of the firearm or the ambidextrous bolt catch release button 122 operable from the second side 22 of the firearm. As further described herein, the assembly may be alternated between sides such that the "first side" and "second side" may be either side of the firearm.

In various embodiments, the ambidextrous bolt catch release button 122 may be hingedly connected to the firearm via an ambidextrous hinge pin 102 extending through a proximal end of the ambidextrous bolt catch release button 122 in a vertical direction (e.g., along the height of the firearm in the y-direction). In various embodiments, the ambidextrous bolt catch release button 122 may be defined at least in part by a length that extends in a longitudinal direction along the length of the firearm from the proximal end (e.g., including a tab in some embodiments) hinged at the ambidextrous hinge pin 102 to a distal end (e.g., a knurled or otherwise actuatable end opposite the proximal end) extending away therefrom along the second side 22 of the firearm toward a rear portion of the firearm (e.g., in the negative z-direction). For example, the ambidextrous bolt catch release button 122 may be configured such that a neutral position thereof is defined by at least a portion of the length of the ambidextrous bolt catch release button 122 extending parallel to the second side 22 of the firearm. Further, actuation of the ambidextrous bolt catch release button 122 may result in at least a portion of the ambidextrous bolt catch release button 122 being compressed (e.g., via the hinged motion about the ambidextrous hinge pin 102) into a recess of the second side 22 of the firearm (e.g., the right side relative to the shooter) in an at least partially inward direction. The ambidextrous bolt catch release button 122 may be operable from the second side 22 of the firearm (e.g., the right side) such that a user of the firearm may press an outward-facing surface of ambidextrous bolt catch release button 122 in an at least partially inward direction into the second side 22 of the firearm (e.g., in a positive x-direction).

In various embodiments, as illustrated in FIGS. 4A and 4B, the ambidextrous bolt catch release button 122 and the ambidextrous bolt catch engagement button 121 may each be hinged about a common axis extending in an at least substantially vertical direction (e.g., in the y-direction). For example, the ambidextrous bolt catch release button 122 and the ambidextrous bolt catch engagement button 121 may each be hinged at respective proximal ends thereof about the same ambidextrous hinge pin 102, such that both the ambidextrous bolt catch release button 122 and the ambidextrous bolt catch engagement button 121 may at least partially independently rotate about the ambidextrous hinge pin 102 along a horizontal plane (e.g., an x-z plane) between a neutral position and an actuated (e.g., compressed) position. In such an exemplary configuration, the range of motion of each of the ambidextrous bolt catch release button 122 and the ambidextrous bolt catch engagement button 121 are defined within a horizontal plane (e.g., the x-z plane, as shown) that is at least substantially perpendicular to the height of the firearm (e.g., the y axis). In various embodiments, the bolt catch hinge pin 102 may be positioned along a lateral side of the firearm, such as, for example, the right side of the firearm.

Further, in various embodiments, the ambidextrous bolt catch engagement button 121 and the ambidextrous bolt catch release button 122 may be arranged along the second side 22 of the firearm, such that at least a portion of the length of the ambidextrous bolt catch engagement button 121 is positioned above at least a portion of the length of the ambidextrous bolt catch release button 122, as measured along the height of the firearm (e.g., in the y-direction). Further, in various embodiments, the length of the ambidextrous bolt catch release button 122 may be at least greater than the length of the ambidextrous bolt catch engagement button 121, such that the ambidextrous bolt catch release button 122 may be configured to be actuatable from farther rearward than the ambidextrous bolt catch engagement button 121, and at least a portion of the ambidextrous bolt catch release button 122, such as, for example, at a distal actuatable end, wraps around a respective distal end of the ambidextrous bolt catch engagement button 121 such that both the ambidextrous bolt catch release button 122 and the ambidextrous bolt catch engagement button 121 are operable from a common vertical position along the height of the firearm. In various embodiments, at least a portion of a perimeter of the ambidextrous bolt catch release button 122 may be configured to correspond to an exterior profile of an adjacent portion of the distal end of the ambidextrous bolt catch engagement button 121, such that the at least a portion of the perimeter of the ambidextrous bolt catch release button 122 at least partially extends around the distal end of the ambidextrous bolt catch engagement button 121. For example, in various embodiments wherein the respective proximal ends of the ambidextrous bolt catch release button 122 and the ambidextrous bolt catch engagement button 121 are both coaxially hinged about an ambidextrous hinge pin 102 (e.g., with or without tabs proximal of the hinge point) and the proximal end of the ambidextrous bolt catch engagement button 121 is arranged in a vertically stacked configuration on top of the proximal end of the ambidextrous bolt catch release button 122, a top surface of the ambidextrous bolt catch release button 122 may be defined by a surface geometry that at least substantially mirrors that of an adjacent portion of the perimeter surface of the ambidextrous bolt catch engagement button 121. In various embodiments, the portion of the length of the ambidextrous bolt catch release button 122 that extends beyond the distal end of the ambidextrous bolt catch engagement button 121 (e.g., the distal end of the ambidextrous bolt catch release button 122) may have a height that is at least substantially greater than the height of the ambidextrous bolt catch engagement button 121, such that at least a portion of the of the length of the ambidextrous bolt catch release button 122 extending beyond the distal end of the ambidextrous bolt catch engagement button 121 is positioned in the same vertical position (e.g., along the height of the firearm) as the ambidextrous bolt catch engagement button 121.

In various embodiments, the ambidextrous bolt catch release button 122 and the ambidextrous bolt catch engagement button 121 may each be separately movable relative to the firearm (e.g., independently rotatable about the hinge pin 102). For example, in various embodiments, the ambidextrous bolt catch release button 122 may be moved relative to the ambidextrous bolt catch engagement button 121 such that the ambidextrous bolt catch release button 122 may be actuated without actuating the ambidextrous bolt catch engagement button 121. In various embodiments, the ambidextrous bolt catch engagement button 121 may be actuated without actuating the ambidextrous bolt catch release button 122.

In various embodiments, the ambidextrous bolt catch release button 122 may comprise an interior surface 122*a* defined by an inward-facing surface of the ambidextrous bolt catch release button 122 that is configured to, upon actuation of the ambidextrous bolt catch release button 122, move at least partially towards the first side 21 of the firearm. For example, the ambidextrous bolt catch release button 122 may be configured such that actuation thereof causes the interior surface 122*a* to move in a direction at least partially towards the bolt catch 110. In some embodiments, the interior surface 122*a* may be angled at least partially towards the first side 21 (e.g., shown by the overlap between the inner surface 122*a* and second pushing element 132 in FIGS. 6A-6C). Further, the ambidextrous bolt catch release button 122 may be configured such that actuation thereof causes at least a portion of the interior surface 122*a* to move in a direction at least partially towards a bottom portion of the bolt catch 110 (e.g., laterally towards the first side 21 along the x-direction). The bottom portion of the of the bolt catch 110 may include a portion arranged vertically below the bolt catch hinge pin 101 (e.g., as measured in the y-direction), such that lateral contact with the bottom portion causes a torque and/or moment on the bolt catch 110 about the hinge pin 101. As illustrated, in various embodiments, the ambidextrous bolt catch assembly 100 may comprise a second pushing element 132 configured to engage the interior surface 122*a* of the ambidextrous bolt catch release button 122 and extend at least partially between the interior surface 122*a* and the bolt catch 110. In various embodiments, the second pushing element 132 may be movable by the interior surface 122*a* of the ambidextrous bolt catch release button 122. In various embodiments, the second pushing element 132 may define a physically distinct mechanical component relative to the ambidextrous bolt catch release button 122, at least a portion of which may be arranged at least substantially adjacent the interior surface 122*a* of the ambidextrous bolt catch release button 122 so as to abut the interior surface 122*a* thereof. For example, the second pushing element 132 may comprise a pin having an at least substantially rigid linear configuration. In various embodiments, the second pushing element 132 may be disposed in a channel of the body 20 and may be configured to engage a spring and/or third pushing element and/or bottom portion of the bolt catch on a first end and the ambidextrous bolt catch release button 122 on a second end.

In various embodiments, the second pushing element 132 may be configured such that, upon activation of the ambidextrous bolt catch release button 122, the interior surface 122*a* may engage the second pushing element 132 so as to cause the second pushing element 132 to move in a linear direction (e.g., in a positive x-direction) towards the bolt catch 110. As described in further detail herein, the second pushing element 132 may be configured to, upon actuation of the ambidextrous bolt catch release button 122, laterally translate towards the bolt catch 110 so as to engage a bottom portion of the bolt catch 110, directly or indirectly, and apply a pushing force to a surface (e.g., a surface facing at least partially towards the second side 22 of the firearm) within the bottom portion of the bolt catch 110, thereby causing the bolt catch 110 to rotate in the second rotational direction towards the disengaged position. For example, in various embodiments, the second pushing element 132 may be configured to engage the bolt catch 110 at a clockwise-facing surface (e.g., clockwise about the hinge pin 101 relative to the orientation shown in FIGS. 6A-6C) of the bolt catch 110 that defines at least a portion of an arm 115 of the bolt catch 110, the clockwise-facing surface being arranged on an opposing side of the arm 115 relative to the first bolt catch engagement button 111 so as to cause the bolt catch 110 to rotate in the second rotational direction by applying a pushing force at a backside of the first bolt catch engagement button 111, as described herein.

Figure 6A:
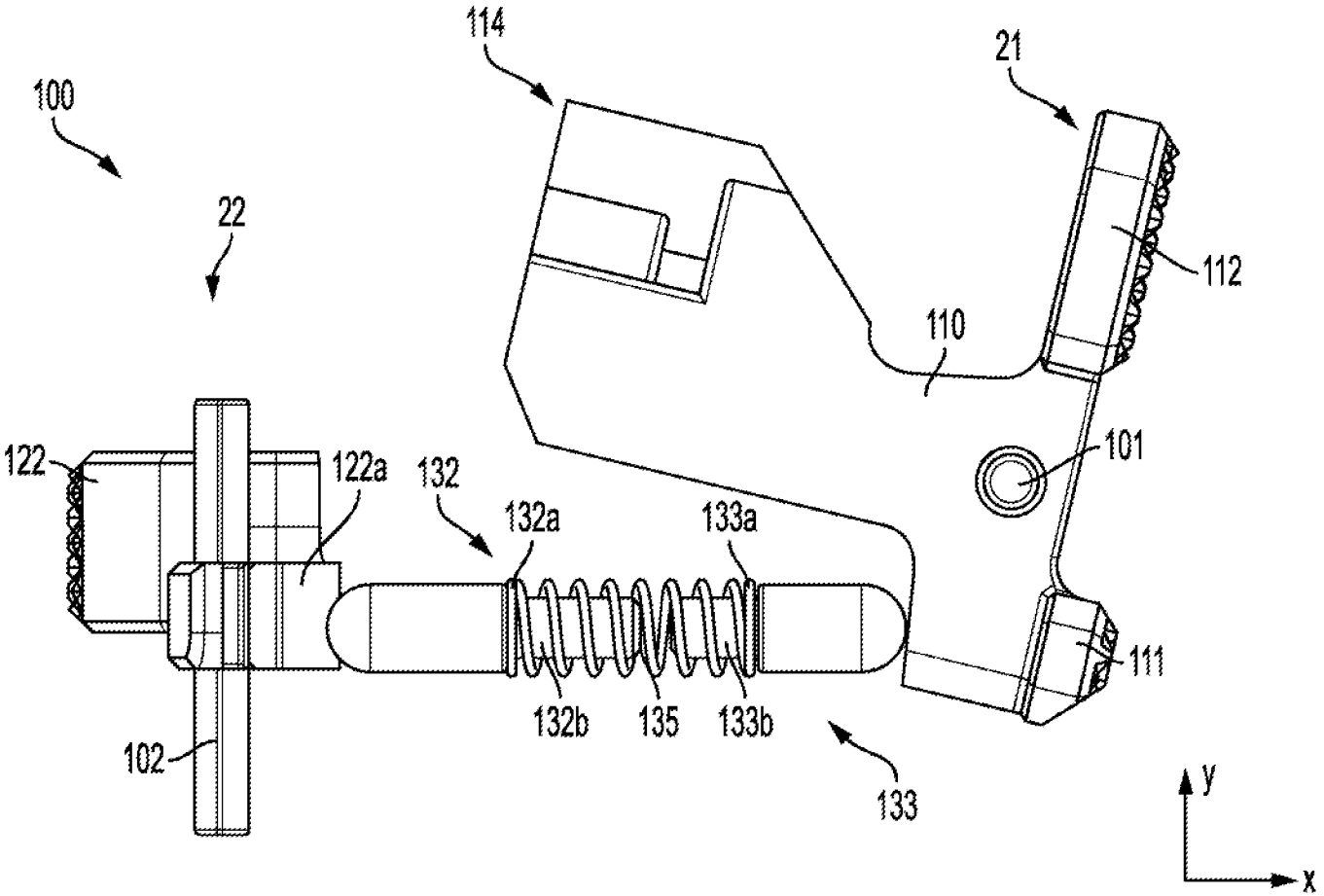
FIGS. 6A-6C illustrate various views of exemplary ambidextrous bolt catch controls in accordance with various embodiments.
Figure 6B:
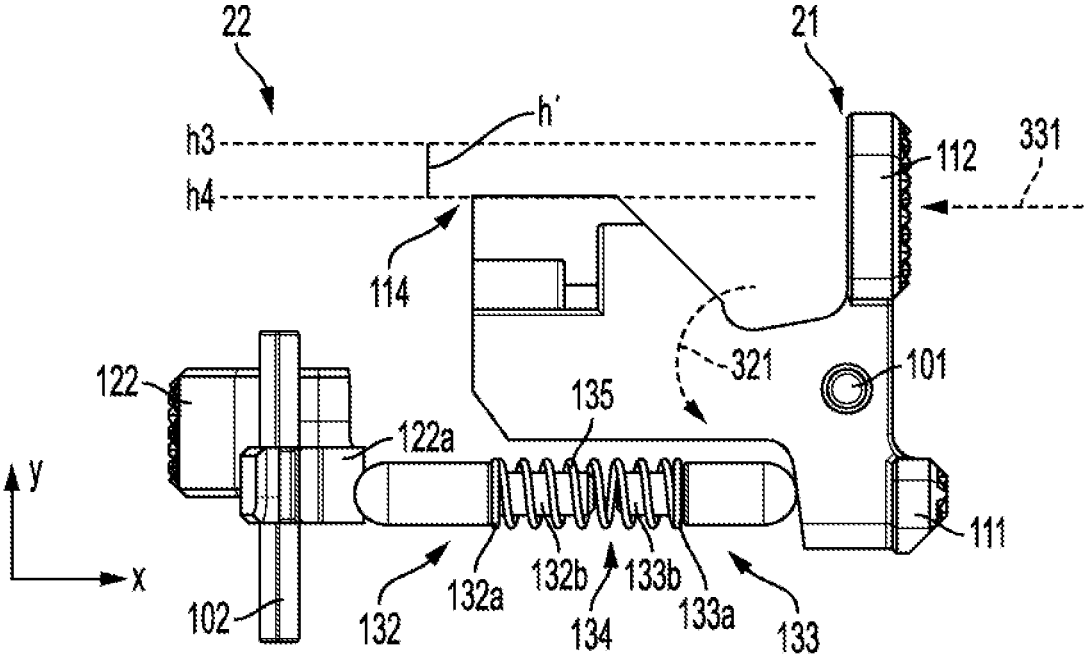
Figure 6C:
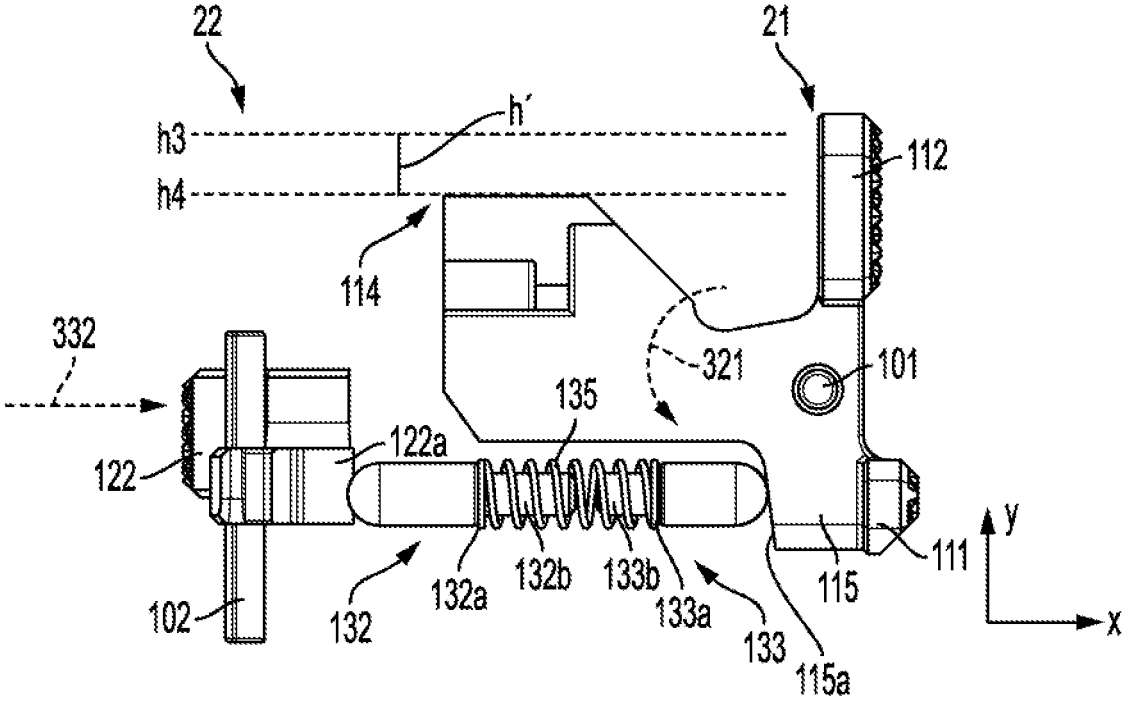

Additionally, or alternatively, in various embodiments, ambidextrous bolt catch assembly 100 may comprise a third pushing element 133 configured to contact the bolt catch 110 and arranged such that at least in an instance in which the bolt catch 110 is in the disengaged position, the third pushing element 133 extends in an at least substantially lateral direction from the bolt catch towards the second side 22 of the firearm (e.g., in the negative x-direction). For example, the third pushing element 133 may comprise a pin having an at least substantially rigid linear configuration. In various embodiments, the third pushing element 133 may be arranged so as to contact an at least partially clockwise-facing surface (e.g., clockwise about the hinge pin 101 relative to the orientation shown in FIGS. 6A-6C) defining at least a portion of the bottom portion of the bolt catch 110. In various embodiments, the third pushing element 133 may be moved by a surface of the bolt catch 110. In various embodiments, the third pushing element 133 may define a physically distinct mechanical component relative to the bolt catch, at least a portion of which may be arranged at least substantially adjacent an at least partially clockwise-facing surface (e.g., clockwise about the hinge pin 101 relative to the orientation shown in FIGS. 6A-6C) within the bottom portion of the bolt catch 110 so as to abut a backside of the arm 115 opposite the first bolt catch engagement button 111. For example, as illustrated in FIGS. 6A-6C, the third pushing element 133 may be configured to engage an at least partially clockwise-facing surface (e.g., clockwise about the hinge pin 101 relative to the orientation shown in FIGS. 6A-6C) within the bottom portion of the bolt catch 110 that defines at least a portion of an arm 115 and is arranged on an opposing side of the arm 115 relative to the first bolt catch engagement button 111. In such an exemplary embodiment, the third pushing element 133 may be configured to transmit one or more pushing forces to the clockwise-facing surface of the bolt catch 110 engaged therewith so as to cause the bolt catch 110 to rotate in the second rotational direction by applying a pushing force at the backside of the first bolt catch engagement button 111, as described herein. In various embodiments, the third pushing element 133 may be disposed in a channel of the body 20 and may be configured to engage a spring and/or second pushing element and/or ambidextrous bolt catch release button 122 on a first end and a portion of the bolt catch on the second end.

In various embodiments, the ambidextrous bolt control assembly 100 may be configured such that the third pushing element 133 may be at least substantially coaxial with the second pushing element 132, such that the elements may be configured to contact each other during at least a portion of each of their movements, which may allow forces from the actuation of the ambidextrous bolt catch release button 122 to at least push the bolt catch 110 towards the disengaged position from the engaged position. In such embodiments, the third pushing element 133 may extend at least part of the distance between the bottom portion of the bolt catch 110 (e.g., a surface within the bottom portion of the bolt catch 110 that defines at least a portion of an arm 115 and is arranged on an opposing side of the arm 115 relative to the first bolt catch engagement button 111) and the second pushing element 132 such that the third pushing element 133 and the second pushing element 132 are at least substantially aligned along a lateral axis (e.g., both elements may be disposed in a single channel extending from the ambidextrous bolt catch release button 122 to the bolt catch 110). In various embodiments, the third pushing element 133 and the second pushing element 132 may be separated by a lateral gap 134 extending therebetween (e.g., as shown in FIGS. 4B and 6B). For example, in various embodiments, the lateral gap 134 between the third pushing element 133 and the second pushing element 132 may define a distance such that, in an instance in which the ambidextrous bolt catch release button 122 is in a neutral position, the bolt catch 110 may be able to rotate in the first rotational direction between the disengaged position and the engaged position in response to actuation of the first bolt catch engagement button 111 without the second pushing element 132 contacting the third pushing element 133. Similarly, actuation of the ambidextrous bolt catch release button 122 in an instance in which the bolt is already released and the bolt catch 110 is in a neutral, disengaged position may have no effect in some embodiments. Further, in various embodiments, a spring element (e.g., spring element 135 shown in FIGS. 4B, 6A-6C) may be disposed between the second pushing element 132 and the third pushing element 133 (e.g., contacting flanges on each respective pushing element and held on the pushing elements by centering protrusions having a narrower diameter than the rest of the pushing elements, which centering protrusions extend inwardly towards the other respective element). As described in further detail herein, the second pushing element 132 may be configured to, upon actuation of the ambidextrous bolt catch release button 122, be laterally translated toward the first side 21 of the firearm so as to engage the third pushing element 133 and exert a pushing force on the third pushing element 133 at least in an instance in which the bolt catch 110 is in an engaged position (e.g., as shown in FIGS. 6A and 8B). In such an embodiment, the third pushing element 133 may be positioned to transmit at least a portion of the pushing force from the ambidextrous bolt catch release button 122 and/or the spring element 135 to the surface 115*a* of the bottom portion of the bolt catch 110 with which the third pushing element 133 is engaged. As described herein, the third pushing element 133 may be configured to cause the bolt catch 110 to rotate in the second rotational direction by applying the pushing force at the backside of the first bolt catch engagement button 111.

In various embodiments, with reference to FIGS. 4A-4B, 7A-7B, an exemplary ambidextrous magazine release assembly 200 may comprise an ambidextrous magazine release button 211 operable from the first side 21 of the firearm, a first magazine release button 220 operable from the second side 22 of the firearm, and a lever arm 210 comprising a magazine engagement protrusion 212 extending from the lever arm 210 and configured to engage a magazine in an engaged position. The ambidextrous magazine release button 211 may be integral with and disposed at one end of the lever arm 210. As described in further detail herein in reference to FIGS. 7A and 7B, the ambidextrous magazine release assembly 200 may be configured such that, upon actuation of the ambidextrous magazine release button 211, the magazine engagement protrusion 212 may disengage from a magazine by a rotational motion enabled by the hinged configuration (e.g., via hinge pivot 213) of the lever arm 210 and the configuration of the ambidextrous magazine release button 211 relative thereto. Further, as described herein, upon actuation of the first magazine release button 220, the magazine engagement protrusion 212 may disengage from a magazine by a lateral translation enabled by the spring-loaded configuration of the first magazine release button 220 and the configuration of the lever arm 210 relative thereto.

In various embodiments, an exemplary ambidextrous magazine release assembly 200 may be positioned within a firearm 10 at least substantially beneath the ambidextrous bolt control assembly 100, as measured along the height of the firearm (e.g., in the y-direction). For example, in various embodiments, the ambidextrous magazine release button 211 may be arranged along a first side 21 of the firearm, and may define the bottom-most button of a plurality of buttons (e.g., including the first bolt catch engagement button 111 and the first bolt catch release button 112) arranged in a vertically stacked configuration along the first side 21 of the firearm. Further, in various embodiments, the first magazine release button 220 may be arranged along a second side 22 of the firearm, and may define the bottom-most button of a plurality of buttons (e.g., including the ambidextrous bolt catch engagement button 121 and the ambidextrous bolt catch release button 122) arranged along the second side 22 of the firearm. Further still, in various embodiments, the rod 230 that extends between the first magazine release button 220 and the ambidextrous magazine release button 211 may be configured to extend along a linear axis that is at least substantially parallel to a central axis extending through the second and third pushing elements 132, 133 of the ambidextrous bolt assembly 100.

Figure 5A:
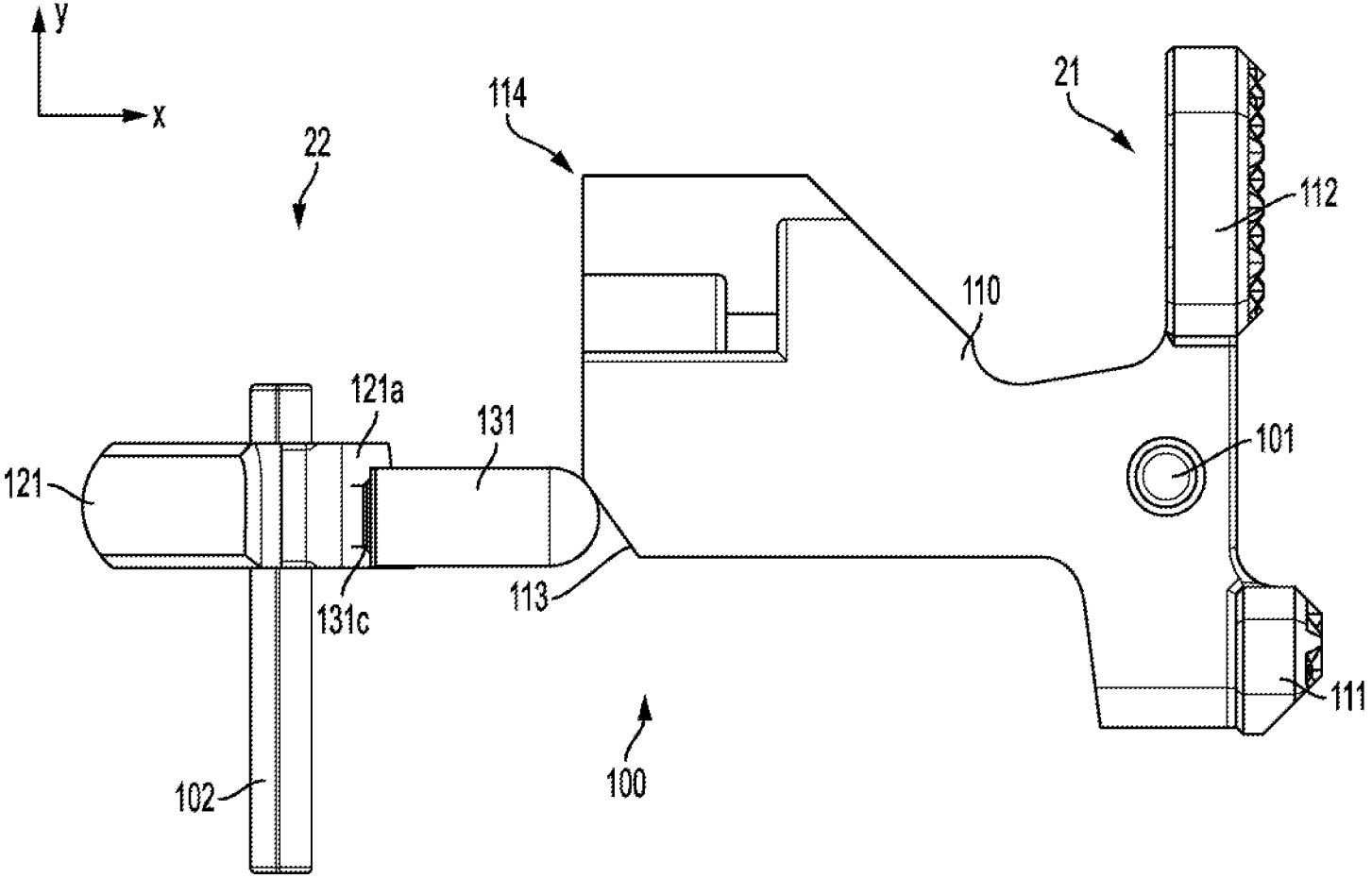
FIGS. 5A-5C illustrate various views of exemplary ambidextrous bolt catch controls in accordance with various embodiments.
Figure 5B:
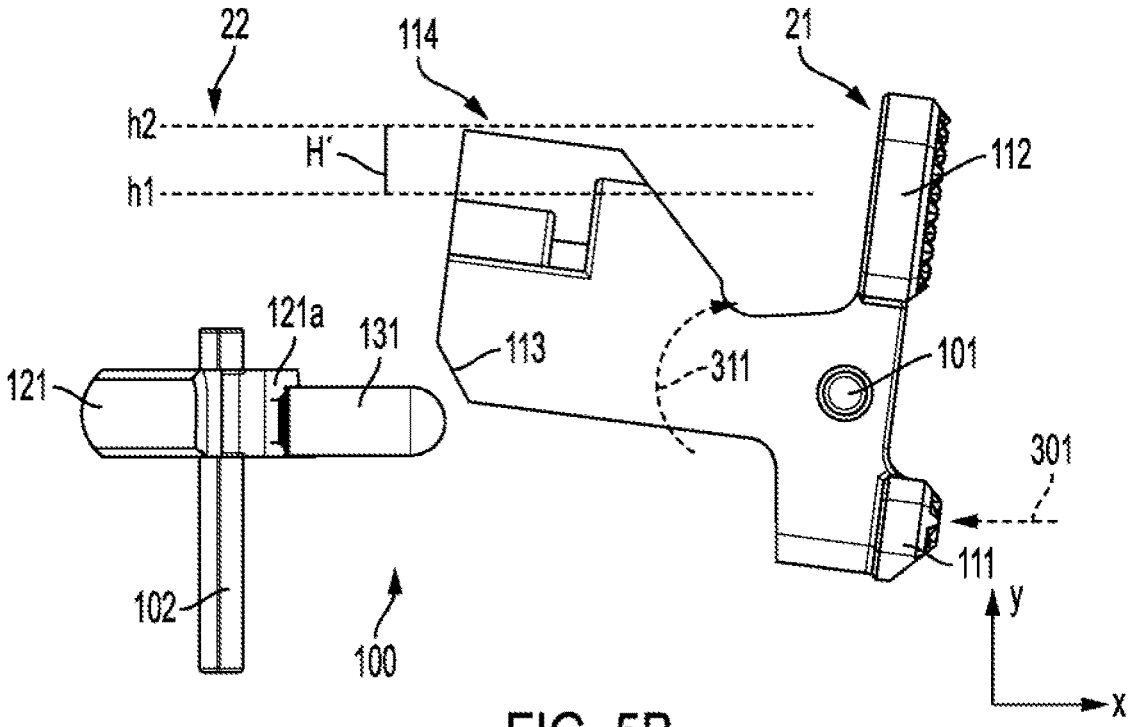
Figure 5C:
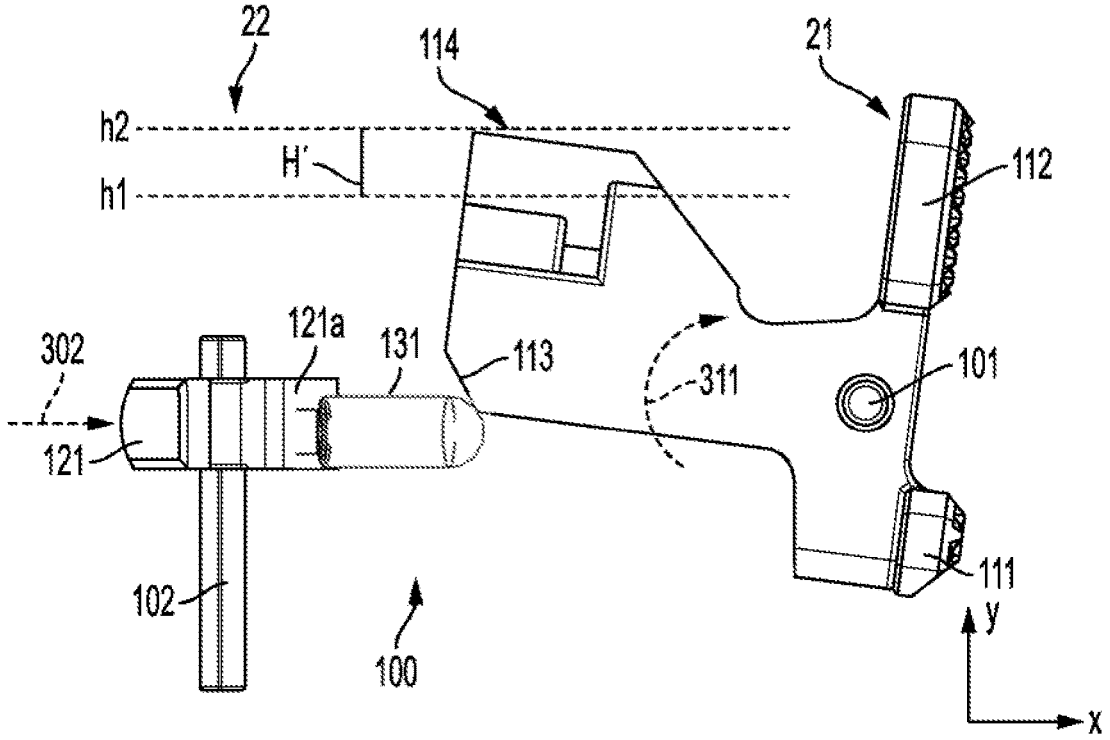

FIGS. 5A-5C illustrate various views of exemplary ambidextrous bolt controls in accordance with various embodiments. For simplicity and ease of illustration, the ambidextrous bolt catch engagement button 121 and related components are shown without a corresponding bolt catch release button and related components; however, one of ordinary skill in the art will appreciate, in light of the present disclosure, that the ambidextrous bolt catch engagement and release assemblies described herein may be used together or separately. In particular, FIG. 5A shows a portion of an exemplary ambidextrous bolt control assembly 100 comprising a bolt catch 110 arranged in a disengaged position. As described herein, the ambidextrous bolt control assembly 100 includes a first bolt catch engagement button 111 and an ambidextrous bolt catch engagement button 121, each of which are shown in neutral positions. As described herein, a neutral position of an exemplary component of an ambidextrous firearm control assembly (e.g., first bolt catch engagement button 111, ambidextrous bolt catch engagement button 121, first bolt catch release button 112, ambidextrous bolt catch release button 122) may be defined by a stable position assumed by the exemplary component when the component is not being actuated and the bolt catch 110 is in a disengaged position. For example, as illustrated, the respective neutral positions of the first bolt catch engagement button 111 and the ambidextrous bolt catch engagement button 121 are defined by stable positions in which the buttons 111, 121 are respectively arranged when they are not being actuated (e.g., pressed). In some embodiments, the respective buttons may not be pressed past their neutral positions (e.g., in an unintended direction not between the engaged and disengaged positions) via one or more limiting structural features.

As shown, in various embodiments, an ambidextrous bolt control assembly 100 may include a bolt catch 110 that is hingedly connected to the firearm about a bolt catch hinge pin 101 that extends along a lateral hinge axis (e.g., in the z-direction). As described herein, a first bolt catch engagement button 111 may be secured along an exterior surface of the bolt catch 110 in a position at least substantially below the hinge axis of bolt catch 110, such that an actuation of the first bolt catch engagement button 111 may impart a torque and a moment on the bolt catch 110, as described herein. Further, an ambidextrous bolt catch engagement button 121 may be configured such that, upon activation thereof via rotational movement about the hinge pivot 102, the ambidextrous bolt catch engagement button 121 may cause a first pushing element 131 engaged with interior surface 121*a* to at least laterally translate in a linear direction (e.g., in a positive x-direction) towards the bolt catch 110 so as to engage an angled engagement interface 113 positioned along an exterior surface of the bolt catch 110. In some embodiments, the first pushing element 131 may move in a channel formed in the lower receiver and may abut or engage the bolt catch engagement button 121. In some embodiments, the first pushing element 131 may include an engagement end 131*c* that may insert at least partially into an opening in the bolt catch engagement button 121. The engagement end 131*c* may cause rotation and/or translation of the first pushing element 131, while still permitting contact of the angled engagement interface 113 to achieve the functions described herein. The angled engagement interface 113 may be aligned with the first pushing element 131 and positioned relative to the bolt catch hinge pin 101 such that the first pushing element 131 engaging the bolt catch (e.g., at the angled engagement interface 113) may impart a non-lateral torque and a moment on the bolt catch 110, as described herein (e.g., the lateral movement of the pin 131 in the x-direction against the angled engagement interface 113 may create a net rotational force on the bolt catch 110 about the hinge pin 101 in the first rotational direction 311). For example, a non-lateral torque and a moment imparted on the bolt catch 110 as a result of the first bolt catch engagement button 111 being actuated and a non-lateral torque and moment imparted on the bolt catch 110 as a result of the ambidextrous bolt catch engagement button 121 being actuated may each cause the bolt catch 110 to rotate in the same rotational direction (e.g., the first rotational direction) towards the engaged position, as described herein.

FIGS. 5B and 5C illustrate exemplary embodiments wherein, in response to an actuation of the first bolt catch engagement button 111 and the ambidextrous bolt catch engagement button 121, respectively, the bolt catch 110 is rotated to an engaged position. For example, the embodiment illustrated in FIG. 5B represents an exemplary circumstance wherein the bolt catch 110 is configured in an engaged position as a result of an actuation of the first bolt catch engagement button 111 by a force 301. As illustrated, an actuation of first bolt catch engagement button 111 may be embodied by the first bolt catch engagement button 111 being pressed from a first side 21 of the firearm, such that a pressing force 301 is imparted on the first bolt catch engagement button 111 in an at least substantially inward lateral direction from the first side 21 of the firearm (e.g., in the negative x-direction). As described herein, first bolt catch engagement button 111 may be positioned at least substantially below the lateral hinge axis of the bolt catch hinge pin 101, such that a pressing force 301 applied to the first bolt catch engagement button 111 may impart a moment on the bolt catch 110 that causes the bolt catch 110 to rotate in the first rotational direction 311 to the engaged position. As illustrated, the first rotational direction 311 may be defined by a clockwise rotation of the bolt catch 110 about the bolt catch hinge pin 101, as viewed from a front perspective of the firearm looking along the length of the firearm towards the rear portion of the firearm.

In various embodiments, as illustrated in FIG. 5B, a rotation of the bolt catch 110 in the first rotational direction 311 to an engaged position that is caused by an actuation of the first bolt catch engagement button 111 may further result in the first bolt catch engagement button 111 being reconfigured from a previously described neutral position to a compressed position. For example, when the bolt catch 110 is configured in an engaged position, as illustrated, the first bolt catch engagement button 111 may be arranged in a compressed position that is a lateral distance away (e.g., in a negative x-direction) from the neutral position of the first bolt catch engagement button 111 (e.g., displaced into a recess in the body 20). Further, in such an exemplary circumstance wherein the bolt catch 110 is rotated to the engaged position as the result of the first bolt catch engagement button 111 being actuated, the ambidextrous bolt catch engagement button 121 may remain in the neutral position as shown in FIG. 5B. For example, the bolt catch 110 may pivot away from the ambidextrous bolt catch engagement button 121 (e.g., from the first pushing element 131 extending therebetween) as the pushing force 301 causes the bolt catch 110 to rotate in the first rotational direction 311 to the engaged position. In various embodiments, the ambidextrous bolt catch engagement button 121 may be configured to remain in a neutral position until actuated, as described herein.

In various embodiments, an engaged position of an exemplary bolt catch 110, such as, for example, the arrangements illustrated in FIGS. 5B and 5C, may be defined at least in part by a configuration wherein at least a portion of the bolt catch 110 is positioned within a travel path of a bolt disposed within the firearm such that the bolt catch 110 may engage the bolt to at least partially restrict the bolt's movement within the firearm. For example, in various embodiments, a bolt catch 110 may comprise a protrusion 114 configured to engage a bolt of the firearm when the bolt catch 110 is positioned in the engaged position. In various embodiments, as the bolt catch 110 is reconfigured from a disengaged position to an engaged position, the protrusion 114 may exhibit a corresponding movement that is defined at least partially in an upward vertical direction (e.g., the movement of the protrusion 114 includes a vertical component that extends in the positive y-direction). As shown, the rotation of bolt catch 110 from a disengaged position, wherein the protrusion 114 is initially arranged in a first vertical position h1 relative to the height of the firearm (e.g., in the y-direction), in a first rotational direction 311 towards the illustrated engaged position causes at least a portion of the protrusion 114 to move rotationally with the rest of the bolt catch 110 such that the protrusion 114 moves partially in the positive y-direction (e.g., in an upward vertical direction) to a second vertical position h2. For example, in various embodiments, the vertical component of the movement exhibited by the protrusion 114 as the bolt catch 110 rotates from the disengaged position to the engaged position may define a vertical protrusion displacement H'. In various embodiments, an ambidextrous bolt control assembly 100 may be configured such that the protrusion 114 being positioned in the second vertical position h2 may engage the bolt of the firearm to facilitate the bolt catch engagement operation of the firearm whereas the protrusion 114 being positioned in the first vertical position h1 may allow the bolt to pass freely overhead. In some embodiments, the bolt catch 110 can only rotate fully into the engaged position in an instance in which the bolt is retracted.

As a further illustrative example, the embodiment illustrated in FIG. 5C represents an exemplary circumstance wherein the bolt catch 110 is configured in an engaged position as a result of an actuation of the ambidextrous bolt catch engagement button 121 with a force 302. As illustrated, an actuation of ambidextrous bolt catch engagement button 121 may be embodied by the ambidextrous bolt catch engagement button 121 being pressed from a second side 22 of the firearm, such that a pressing force 302 is imparted on the ambidextrous bolt catch engagement button 121 in an at least substantially inward lateral direction from the second side 22 of the firearm (e.g., in the positive x-direction). In various embodiments, the ambidextrous bolt catch engagement button 121 may be hingedly connected to the firearm about an ambidextrous hinge pin 102 extending through the ambidextrous bolt catch engagement button 121 in a vertical direction (e.g., in the y-direction). In such an exemplary circumstance, upon actuation of the ambidextrous bolt catch engagement button 121, such as, for example, by a pressing force 302 being applied thereto, the ambidextrous bolt catch engagement button 121 may rotate about the ambidextrous hinge pin 102 such that at least a portion of the ambidextrous bolt catch engagement button 121 rotates about the hinge pin 102 towards the bolt catch 110 (e.g., in the positive x-direction).

The ambidextrous bolt catch engagement button 121 may include an internal surface 121*a* that may be engaged with a first pushing element 131, as described herein. In various embodiments, an actuated ambidextrous bolt catch engagement button 121 rotating about the hinge pin 102 may impart a lateral force onto the first pushing element 131 (e.g., via internal surface 121*a*), which may cause the first pushing element 131 to translate laterally (e.g., along the x-direction) towards the bolt catch 110. In various embodiments, the first pushing element 131 may engage the bolt catch 110 at the angled engagement interface 113. The angled engagement interface 113 may be configured such the laterally translated first pushing element 131 may create a moment that acts on the bolt catch 110. For example, the angled engagement interface 113 may be positioned relative to a bolt catch hinge pin 101 such that the engagement of the first pushing element 131 to the angled engagement interface 113 results in a clockwise moment (e.g., clockwise relative to the front-view perspective of FIGS. 5A-5C) being imparted on the bolt catch 110 that causes the bolt catch 110 to rotate in the first rotational direction 311 to the engaged position.

In various embodiments, as illustrated in FIG. 5C, a rotation of the ambidextrous bolt catch engagement button 121 from a previously described neutral position to a compressed position may cause the bolt catch 110 to rotate in the first rotational direction 311 to an engaged position. For example, when the bolt catch 110 is configured in an engaged position, as illustrated, the ambidextrous bolt catch engagement button 121 may be arranged in a position that is a lateral distance away (e.g., in a positive x-direction) from the neutral position of the ambidextrous bolt catch engagement button 121 (e.g., disposed in a recess in the second side 22 of the body 20). Further, in such an exemplary circumstance wherein the bolt catch 110 is rotated to the engaged position as the result of the ambidextrous bolt catch engagement button 121 being actuated, the first bolt catch engagement button 111 may similarly be arranged in a respective compressed position. For example, the first bolt catch engagement button 111 may be integral with or rigidly secured to the bolt catch 110, such any rotation of the bolt catch 110 to the engaged position may cause the first bolt catch engagement button 111 to be reconfigured to a compressed position.

In various embodiments, as the bolt catch 110 is reconfigured from a disengaged position to an engaged position based at least in part on an actuation of the ambidextrous bolt catch engagement button 121, at least a portion of the bolt catch 110, such as, for example, a protrusion 114 may exhibit a corresponding rotational movement with the bolt catch that is defined at least partially in an upward vertical direction (e.g., the movement of the protrusion 114 includes a vertical component that extends in the positive y-direction). As shown, the rotation of bolt catch 110 from a disengaged position, wherein the protrusion 114 is initially arranged in a first vertical position h1 relative to the height of the firearm (e.g., in the y-direction), in a first rotational direction 311 towards the illustrated engaged position causes at least a portion of the protrusion 114 to move in the positive y-direction to a second vertical position h2. In this respect, upon actuation of either the ambidextrous bolt catch engagement button 121 or the first bolt catch engagement button 111, the vertical displacement of the portion of the bolt catch 110 configured to engage the bolt of the firearm (e.g., the protrusion 114) may be at least substantially the same. For example, in various embodiments, the vertical component of the movement exhibited by the protrusion 114 as a result of an actuation of the ambidextrous bolt catch engagement button 121 may define a vertical protrusion displacement H'. In various embodiments, an ambidextrous bolt control assembly 100 may be configured such that the protrusion 114 positioned in the second vertical position h2 may engage the bolt of the firearm to facilitate the bolt catch engagement operation of the firearm, as described herein.

FIGS. 6A-6C illustrate various views of exemplary ambidextrous bolt controls in accordance with various embodiments. For simplicity and ease of illustration, the ambidextrous bolt catch release button 122 and related components are shown without a corresponding bolt catch engagement button and related components; however, one of ordinary skill in the art will appreciate, in light of the present disclosure, that the ambidextrous bolt catch engagement and release assemblies described herein may be used together or separately. In particular, FIG. 6A shows a portion of an exemplary ambidextrous bolt control assembly 100 comprising a bolt catch 110 arranged in an engaged position. As described herein, the ambidextrous bolt control assembly 100 may include a first bolt catch release button 112, which may be configurable between a neutral position and an extended position based at least in part on actuation thereof and/or any other actuation resulting in a rotational movement of the bolt catch 110 between a disengaged position (e.g., as shown in FIGS. 6B-6C) and an engaged position (e.g., as shown in FIG. 6A). For example, as illustrated, the extended position of the first bolt catch release button 112 is defined by the first bolt catch release button 112 being disposed a lateral distance away (e.g., in a positive x-direction) from the neutral position of the first bolt catch release button 112 and/or a first side 21 of the firearm. Further, the ambidextrous bolt control assembly 100 may include an ambidextrous bolt catch release button 122, which may be configurable between a neutral position and a compressed position based at least in part on actuation thereof. As illustrated in FIGS. 6A-6B, the neutral position of the ambidextrous bolt catch release button 122 is defined by a stable position in which the ambidextrous bolt catch release button 122 is arranged when it is not being actuated (e.g., pressed).

In various embodiments, a first bolt catch release button 112 may be integral with or rigidly secured along an exterior surface of the bolt catch 110 in a position at least substantially above the bolt catch hinge pin 101 extending through the bolt catch 110, such that an actuation of the first bolt catch release button 112 may impart a non-lateral torque and a moment on the bolt catch 110 to release the bolt, as described herein. Further, an ambidextrous bolt catch release button 122 may be configured such that, upon activation thereof, the ambidextrous bolt catch release button 122 rotates about the ambidextrous hinge pin 102 such that at least a portion of an interior surface 122*a* of the ambidextrous bolt catch release button 122 rotates towards the bolt catch 110 (e.g., in the positive x-direction). The interior surface 122*a* may engage a second pushing element 132 positioned at least substantially adjacent thereto. In various embodiments, the second pushing element 132 may be configured such that the engagement of the ambidextrous bolt catch release button 122 therewith via the interior surface 122*a* imparts a lateral pushing force on the second pushing element 132 that may cause the second pushing element 132 to translate in a linear direction (e.g., in a positive x-direction) towards the first side 21 of the firearm. As described herein, the ambidextrous bolt control assembly 100 may comprise a third pushing element 133 that may be operatively in contact with a bottom portion of the bolt catch 110 and aligned (e.g., coaxial) with the second pushing element 132 in an opposite-facing direction. As illustrated, the third pushing element 133 may be configured to engage an at least partially clockwise-facing surface (e.g., clockwise relative to the front-view of FIGS. 6A-6C) at the bottom portion of the bolt catch 110. For example, the third pushing element 133 may engage the bolt catch 110 at a backside of the arm 115 opposite the first bolt catch engagement button 111, defined by an arm surface 115*a* of an arm 115 defined at the bottom portion of the bolt catch 110. As the second pushing element 132 is translated laterally towards the first side 21 of the firearm, the second pushing element 132 may physically engage the third pushing element 133 aligned therewith and/or the spring 135 may apply a force to the third pushing element 133 such that the second pushing element 132 imparts a lateral pushing force on the third pushing element 133, causing the third pushing element 133 to translate in the linear direction towards the first side 21 of the firearm (e.g., in a positive x-direction). In such an exemplary circumstance, the ambidextrous bolt control assembly 100 may be configured such that the third pushing element 133 imparts a non-lateral torque and a moment on the bolt catch 110 at the arm surface 115*a* (e.g., the backside of the first bolt catch engagement button 111) with which the third pushing element 133 is engaged, as described herein. For example, a non-lateral torque and a moment imparted on the bolt catch 110 as a result of the first bolt catch release button 112 being actuated and a non-lateral torque (e.g., a moment) imparted on the bolt catch 110 as a result of the ambidextrous bolt catch release button 122 being actuated may each cause the bolt catch 110 to rotate in the same rotational direction (e.g., second rotational direction) towards the disengaged position, as described herein.

In various embodiments, the ambidextrous bolt control assembly 100 may comprise a spring element 135 operatively secured to the second pushing element 132 and the third pushing element 133, at a first end and a second end, respectively, so as to extend between the second pushing element 132 and the third pushing element 133. In various embodiments, the spring element 135 may be configurable between an at least partially compressed position and a neutral position based at least in part on the distance defined by the lateral gap between the second pushing element 132 and the third pushing element 133, as described herein. In various embodiments, a spring element 135 may apply a spring force (e.g., a pushing force) to both the second pushing element 132 in a negative x-direction, and the third pushing element 133 in the positive x-direction. The spring element 135 may apply the pushing force at least in an instance in which the bolt catch 110 is in the engaged position and the ambidextrous bolt catch release button 122 is depressed. In some embodiments, the spring element 135 may apply the pushing force at least in an instance in which the bolt catch 110 is not in the disengaged position regardless of the position of the ambidextrous bolt catch release button 122. In some embodiments, the spring element 135 may rest on flanges 132*a*, 133*a* of each respective pushing element 132, 133 and may be held in the y-z plane by centering protrusions 132*b*, 133*b* having a narrower diameter than the rest of the pushing elements, which centering protrusions extend towards the respective other respective element and may be disposed within the spring element 135. In some embodiments, the centering protrusions of the pushing elements 132, 133 may be configured to contact each other when the ambidextrous bolt catch release button 122 is depressed and the bolt catch 110 is in the engaged position. In various embodiments, the spring element 135 may be configured to facilitate repeatability within the ambidextrous bolt catch assembly 200 by being predisposed to cause one or more assembly components, such as, for example, the ambidextrous bolt catch release button 122 and/or the bolt catch 110 to be reconfigured to a neutral state upon an actuation thereof and/or when no other forces are present (e.g., the spring element 135 may cause the ambidextrous control assembly, including the bolt catch, to default to the neutral position. In some embodiments, the spring force alone may be insufficient to disengage the bolt catch 110 from the bolt when the bolt catch is in the engaged position, and actuation by the ambidextrous bolt catch release button 122 and/or first bolt catch release button 112 may be required.

In various embodiments, the lateral gap 134 between the third pushing element 133 and the second pushing element 132 may define a distance such that, in an instance in which the ambidextrous bolt catch release button 122 is in a neutral position, the bolt catch 110 may be configured to rotate in the first rotational direction to the engaged position in response to actuation of the first bolt catch engagement button 111 without the second pushing element 132 contacting the third pushing element 133.

FIGS. 6B and 6C illustrate exemplary embodiments wherein, in response to an actuation of the first bolt catch release button 112 (FIG. 6B) and the ambidextrous bolt catch release button 122 (FIG. 6C), respectively, the bolt catch 110 is rotated to a disengaged position. For example, the embodiment illustrated in FIG. 6B represents an exemplary circumstance wherein the bolt catch 110 is configured to the disengaged position from the engaged position as a result of an actuation of the first bolt catch release button 112. As illustrated, an actuation of first bolt catch release button 112 may be embodied by the first bolt catch release button 112 being pressed from a first side 21 of the firearm, such that a pressing force 331 is imparted on the first bolt catch release button 112 in an at least substantially inward lateral direction from the first side 21 of the firearm (e.g., in the negative x-direction). As described herein, first bolt catch release button 112 may be positioned at least substantially above the lateral hinge axis of the bolt catch hinge pin 101, such that a pressing force 331 applied to the first bolt catch release button 112 may impart a moment on the bolt catch 110 that causes the bolt catch 110 to rotate in a second rotational direction 321 to the disengaged position. As illustrated, the second rotational direction 321 may be defined by a counterclockwise rotation of the bolt catch 110 about the bolt catch hinge pin 101, as viewed from a front perspective of the firearm looking along the length of the firearm towards the rear portion of the firearm in the view of FIGS. 6A-6C.

In various embodiments, as illustrated in FIG. 6B, a rotation of the bolt catch 110 in the second rotational direction 321 to a disengaged position that is caused by an actuation of the first bolt catch release button 112 may further result in the first bolt catch release button 112 being reconfigured from a previously described extended position to a neutral position. For example, when the bolt catch 110 is configured in a disengaged position, as illustrated, the first bolt catch release button 112 may be arranged in a neutral position that is a lateral distance away (e.g., in a negative x-direction) from the extended position of the first bolt catch release button 112. Further, in such an exemplary circumstance wherein the bolt catch 110 is rotated from the engaged position to the disengaged position as the result of the first bolt catch release button 112 being actuated, the ambidextrous bolt catch release button 122 may remain in the neutral position. For example, as the pushing force 331 causes the bolt catch 110 to rotate in the second rotational direction 321 to the disengaged position, the arm 115 of the bolt catch 110, including the first bolt catch engagement button 111 and the arm surface 115*a* configured to engage the third pushing element 133, may similarly rotate in the second rotational direction 321 such that the first bolt catch engagement button 111 is rotated towards a neutral position, as described herein. In various embodiments, at least a portion of a force imparted on the third pushing element 133 by the bolt catch 110 (e.g., the arm surface 115*a* engaged therewith) in reaction to the force of the spring element 135 may be reduced or alleviated as the arm 115 rotates in the second rotational direction 321 away from the third pushing element 133. In such an exemplary circumstance, the spring force acting on the third pushing element 133 in the positive x-direction may cause the third pushing element 133 to move in a laterally outward direction to (e.g., with the arm 115 of the bolt catch 110) as the bolt catch moves towards the disengaged position. As described herein, the second pushing element 132 and the third pushing element 133 may result in a lateral gap 134 therebetween that defines a distance configured to minimize undesirable physical interference between various dynamic components of the ambidextrous bolt catch assembly 100, such as, for example, between the second pushing element 132 and the third pushing element 133 during an actuation of the first bolt catch engagement button 111. In various embodiments, the ambidextrous bolt catch release button 122 may be configured to remain in a neutral position until actuated, as described herein.

In various embodiments, a disengaged position of an exemplary bolt catch 110, such as, for example, the arrangements illustrated in FIGS. 6B and 6C, may be defined at least in part by a configuration wherein no portion of the bolt catch 110 is positioned within the travel path of a bolt disposed within the firearm such that the bolt may move freely within the firearm without obstruction from any portion of the bolt catch 110. In various embodiments, as the bolt catch 110 moves from an engaged position to a disengaged position, a protrusion 114 of the bolt catch 110, as described herein, may exhibit a corresponding movement that is defined at least partially in a downward vertical direction (e.g., the movement of the protrusion 114 includes a vertical component that extends in the negative y-direction). As shown, the rotation of bolt catch 110 from an engaged position, wherein the protrusion 114 is arranged in a first vertical position h3 relative to the height of the firearm (e.g., in the y-direction), in the second rotational direction 321 towards the illustrated disengaged position causes at least a portion of the protrusion 114 to move in the negative y-direction (e.g., in a downward vertical direction) to a second vertical position h4. For example, in various embodiments, the vertical component of the movement exhibited by the protrusion 114 as the bolt catch 110 rotates from the engaged position to the disengaged position may define a vertical protrusion displacement h'. In the depicted embodiments, the heights h3 and h4 of FIGS. 6B-6C may be the same as the heights h2 and h1 of FIGS. 5B-5C.

With reference to FIG. 6C, an exemplary circumstance is depicted wherein the bolt catch 110 is configured in a disengaged position as a result of an actuation of the ambidextrous bolt catch release button 122 with a force 332. As illustrated, an actuation of ambidextrous bolt catch release button 122 may be embodied by the ambidextrous bolt catch release button 122 being pressed from a second side 22 of the firearm, such that a pressing force 332 is imparted on the ambidextrous bolt catch release button 122 in an at least substantially inward lateral direction from the second side 22 of the firearm (e.g., in the positive x-direction). In various embodiments, the ambidextrous bolt catch release button 122 may be hingedly connected to the firearm about an ambidextrous hinge pin 102 extending through the ambidextrous bolt catch release button 122 in a vertical direction (e.g., in the y-direction). In such an exemplary circumstance, upon actuation of the ambidextrous bolt catch release button 122, such as, for example, by a pressing force 332 being applied thereto, the ambidextrous bolt catch release button 122 may rotate about the ambidextrous hinge pin 102 (e.g., into a recess of the body 20) such that at least a portion of the ambidextrous bolt catch release button 122 moves in a lateral direction towards the bolt catch 110 (e.g., in the positive x-direction). In various embodiments, both the ambidextrous bolt catch engagement button and the ambidextrous bolt catch release button 122 may be hingedly connected to the firearm about an ambidextrous hinge pin 102. In such an exemplary circumstance, the ambidextrous bolt catch engagement button 121 and the ambidextrous bolt catch release button 122 are each separately movable relative to the firearm. For example, as a nonlimiting example, in various embodiments, the ambidextrous bolt catch engagement button 121 and the ambidextrous bolt catch release button 122 may each exhibit respective rotations about the ambidextrous hinge pin 102 at least substantially independently of one another.

The ambidextrous bolt catch release button 122 may include an internal surface 122*a* that may be engaged with a second pushing element 132, as described herein. In various embodiments, an actuated ambidextrous bolt catch release button 122 may impart a lateral force onto the second pushing element 132 (e.g., via internal surface 122*a*), which may cause the second pushing element 132 to translate laterally towards the bolt catch 110. In various embodiments, the second pushing element 132 may translate laterally towards a third pushing element 133 aligned (e.g., coaxial) therewith in an opposite direction and operatively engaged with a bottom portion of the bolt catch 110. For example, the third pushing element 133 may engage the bolt catch 110 at a backside of the first bolt catch engagement button 111, defined by a clockwise-facing arm surface 115*a* (e.g., clockwise relative to the orientation shown in FIG. 6C)

of an arm 115 defined at the bottom portion of the bolt catch 110. In the depicted embodiment, as the second pushing element 132 is translated laterally towards the first side 21 of the firearm, the second pushing element 132 may physically engage the third pushing element 133 and impart a lateral pushing force on the third pushing element 133, causing the third pushing element 133 to be pushed in the linear direction into the arm surface 115*a* (e.g., in a positive x-direction). In such an exemplary circumstance, the pushing force of the third pushing element 133 may impart a non-lateral torque and a moment on the bolt catch 110 at the arm surface 115*a* that causes the bolt catch 110 to rotate in the second rotational direction 321 to the disengaged position.

In various embodiments, as illustrated in FIG. 6C, as the bolt catch 110 is reconfigured from an engaged position to a disengaged position based at least in part on an actuation of the ambidextrous bolt catch release button 122, at least a portion of the bolt catch 110 configured to engage a bolt when the bolt catch 110 is arranged in an engaged position, such as, for example, protrusion 114, may exhibit a corresponding movement that is defined at least partially in a downward vertical direction (e.g., the movement of the protrusion 114 includes a vertical component that extends in the negative y-direction). As shown, the rotation of bolt catch 110 from an engaged position, wherein the protrusion 114 is arranged in a first vertical position h3 relative to the height of the firearm (e.g., in the y-direction), in a second rotational direction 332 towards the illustrated disengaged position causes at least a portion of the protrusion 114 to move in the negative y-direction to a second vertical position h4. In this respect, upon actuation of either the ambidextrous bolt catch release button 122 or the first bolt catch release button 112, the vertical displacement of the portion of the bolt catch 110 that was previously engaged with the bolt of the firearm (e.g., the protrusion 114) may be at least substantially the same. For example, in various embodiments, the vertical component of the movement exhibited by the protrusion 114 as a result of an actuation of the ambidextrous bolt catch release button 122 may define a vertical protrusion displacement h'. In various embodiments, an ambidextrous bolt control assembly 100 may be configured such that the protrusion 114 being reconfigured from the first vertical position h3 to the second vertical position h4 may cause the bolt catch 110 to disengage the bolt of the firearm in order to facilitate a bolt catch release operation of the firearm, as described herein.

Figure 7A:
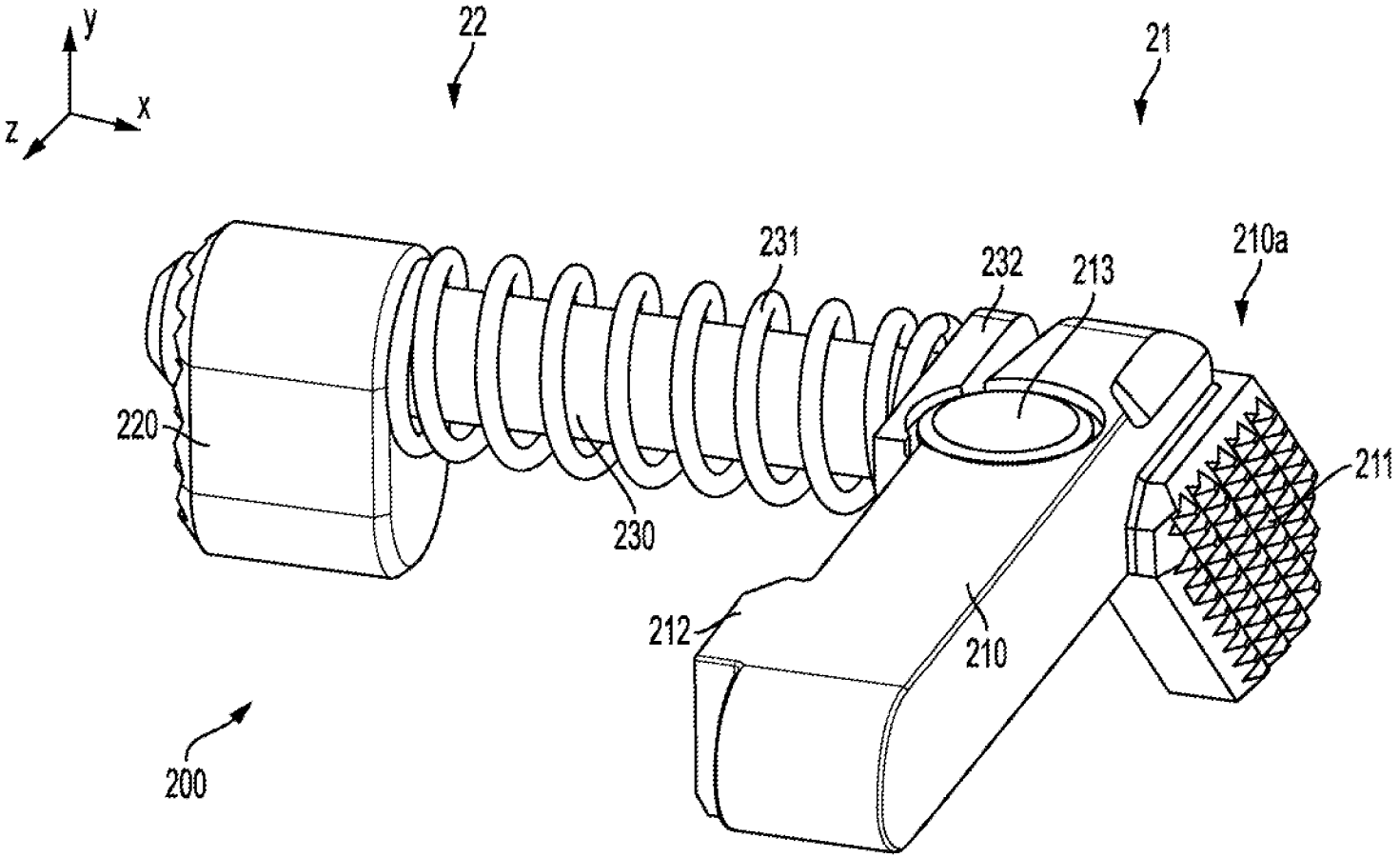
FIGS. 7A-7B illustrate various views of exemplary ambidextrous magazine controls in accordance with various embodiments.
Figure 7B:
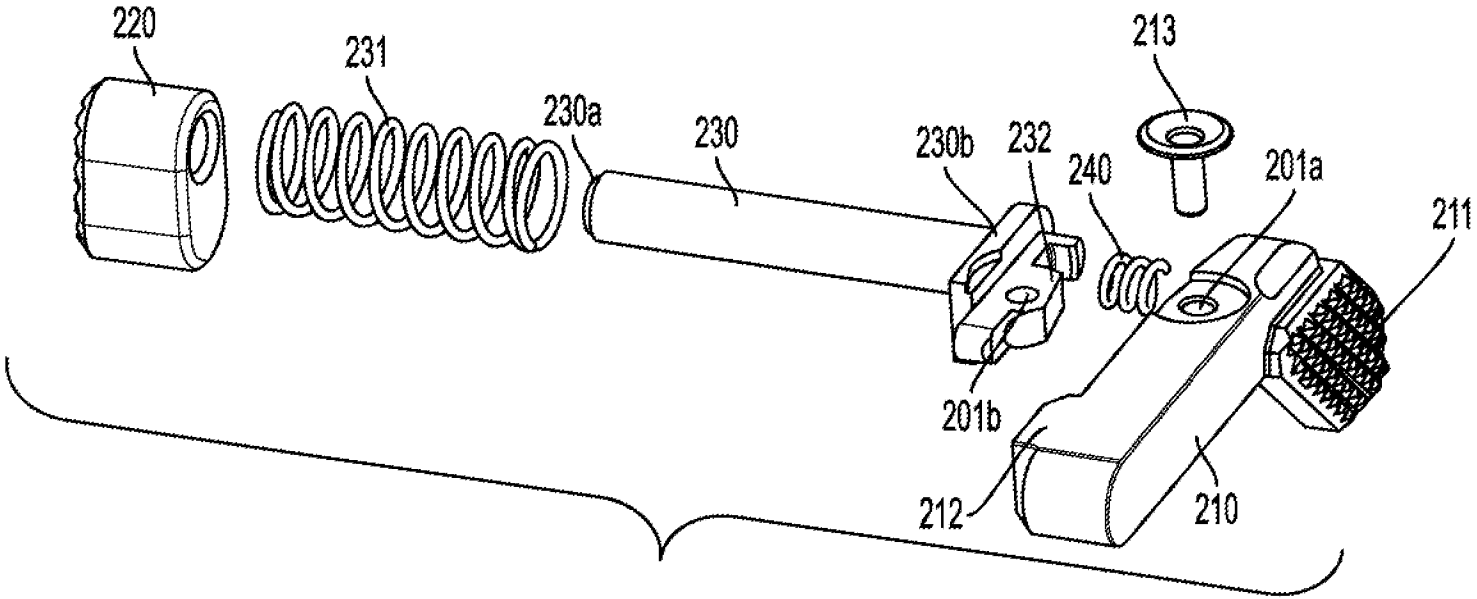

FIGS. 7A and 7B illustrate various views of exemplary ambidextrous rifle controls in accordance with various embodiments. In particular, FIG. 7A and FIG. 7B illustrate a perspective view and an exploded view, respectively, of an ambidextrous magazine release assembly. In various embodiments, as illustrated in FIGS. 7A and 7B, ambidextrous rifle controls may comprise an ambidextrous magazine release assembly 200. As described herein, an ambidextrous magazine release assembly 200 may be configured to facilitate the execution of a magazine release operation from both a first side 21 of the firearm and a second side 22 of the firearm (e.g., both a left side and a right side).

In various embodiments, an exemplary ambidextrous magazine release assembly 200 may comprise a rod 230 extending from a first rod end 230*a* to a second rod end 230*b*. As shown, the ambidextrous magazine release assembly 200 may be configured such that the rod 230 is positioned in an at least substantially lateral direction between the first side 21 of the firearm and the second side 22 of the firearm. For example, in various embodiments, the second rod end 230*b* may define a rod base 232, which may be configured to facilitate a hinged connection 213, 201*b* between the rod 230 and the lever arm 210, and/or receive an end portion of the lever arm spring 240 to bias an ambidextrous magazine release button 211 away the rod base 232, as described herein.

The depicted ambidextrous magazine release assembly 200 may further comprise a lever arm 210 extending from a first arm end 210*a* to a second arm end 210*b*. As shown, the ambidextrous magazine release assembly 200 may be configured such that the lever arm 210 is positioned in an at least partially longitudinal direction along the first side 21 of the firearm. The lever arm 210 may comprise a magazine engagement protrusion 212 extending from the second arm end 210*b* (e.g., at or proximate the distal end of the second arm end) and configured to engage a magazine so as to at least partially restrict the magazine's movement within the firearm. For example, in various embodiments, the magazine engagement protrusion 212 may be configured to physically engage a magazine (not shown) disposed in a magazine well of the firearm when the lever arm 210 is positioned in the engaged position, as described herein. In various embodiments, an exemplary lever arm 210 may further comprise an ambidextrous magazine release button 211 positioned at the first arm end 210*a* of the lever arm 210 and configured to facilitate execution of the magazine release operation of the firearm from a first side 21 of the firearm. For example, the ambidextrous magazine release button 211 may be operable from the first side 21 of the firearm and configured to, upon actuation thereof, cause the magazine engagement protrusion 212 to move in a rotational magazine release direction (e.g., away from the magazine) so as to disengage the magazine and facilitate a magazine release operation of the ambidextrous magazine release assembly 200. For example, a rotational magazine release direction may be defined by counterclockwise rotational direction about the vertical hinge pivot 213, as viewed from a top-down perspective looking down the firearm. In some embodiments, the ambidextrous magazine release button 211 may extend rearward (e.g., in the negative z direction) and/or downward (e.g., in the negative y direction) to facilitate easier access and clearance for the user. In the depicted embodiment, the ambidextrous magazine release button 211 includes angular sides defined at approximately 45 degrees below the negative z axis and end sides respectively defined along the negative y axis and negative z axis and may include knurling for easier actuation. In the depicted embodiment, the ambidextrous magazine release button extends from a lateral side of a main body of the lever arm 210 in the x direction (e.g., at or approximately mid-height on the main body) and extends rearwardly and downwardly towards the trigger below the main body of the lever arm.

The lever arm 210 may be hingedly connected to the firearm via a hinged connection to the rod base 232. For example, as illustrated in FIG. 7B, the lever arm 210 and the rod base 232 may each comprise a hinge orifice, such as, for example, lever arm hinge orifice 201*a* and rod base hinge element 201*b*, respectively, extending at least partially therethrough in a vertical direction. For example, the lever arm 210 and the rod base 232 and may be arranged relative to one another such that the respective hinge orifices 201*a*, 201*b* are coaxially aligned along an at least substantially vertical hinge axis. In such an exemplary configuration, the hinge orifices 201*a*, 201*b* may be configured such that a single vertical hinge pivot 213 (e.g., a pin) may be simultaneously received through each hinge orifice 201*a*, 201*b*, thereby enabling the hinged connection between the lever arm 210 and the rod base 232.

As illustrated, the vertical hinge pivot 213 may be positioned along the length of the lever arm 210 between the magazine engagement protrusion 212 and the ambidextrous magazine release button 211 and may be configured to extend through the lever arm 210 (e.g., and the rod base 232) in an at least substantially vertical direction (e.g., in the y-direction). In such an exemplary configuration, the lever arm 210 may rotate about the vertical hinge pin 213 in either a first lever arm rotational direction towards an engaged position (e.g., wherein the magazine engagement protrusion 212 is engaged with a magazine secured relative to the firearm) or in a second lever arm rotational direction towards a disengaged position (e.g., wherein the magazine engagement protrusion 212 is disengaged with a magazine such that the magazine may release from within the firearm). In such an exemplary configuration, both the first and second lever arm rotational directions are defined within a lateral plane (e.g., a horizontal plane defined by the x and z axes). Further, in various embodiments, the ambidextrous magazine release assembly 200 may further comprise a lever arm spring 240 extending in a lateral direction (e.g., in the x-direction) between an interior surface of the ambidextrous magazine release button 211 and a surface of the rod base 232 aligned therewith. In various embodiments, the lever arm spring 240 may be configured to bias the ambidextrous magazine release button 211 away from the rod base 232 such that, based at least in part on the hinged configuration of the lever arm 210, the magazine engagement protrusion 212 is biased towards the interior of the firearm and/or a magazine arranged therein. In such embodiments, the user may actuate the ambidextrous magazine release button 211 to rotate the lever arm 210 in the second lever arm rotational direction towards the disengaged position and the lever arm spring 240 may urge the lever arm 210 in the first lever arm rotational direction towards the engaged position when not overcome by the force of the user's actuation. The engaged position, whether or not a magazine is inserted into the magazine well of the firearm, may define a neutral position of the ambidextrous magazine release assembly 200.

In various embodiments, the ambidextrous magazine release assembly 200 may further comprise a first magazine release button 220 configured to rigidly connect to the first rod end 230*a*. For example, the rod 230 may be press fit into the first magazine release button 220 or otherwise integral with or secured to the first magazine release button 220 (e.g., via set screw). The first magazine release button 220 may be operable from the second side 22 of the firearm, so as to facilitate execution of the magazine release operation of the firearm from the second side 22 of the firearm. In various embodiments, the first magazine release button 220 may be configured to, upon actuation thereof, cause the magazine engagement protrusion 212 to translate with the lever arm 210 and rod base 232 in a lateral magazine release direction (e.g., away from the magazine) so as to disengage the magazine and facilitate a magazine release operation of the ambidextrous magazine release assembly 200. For example, the lateral magazine release direction may be defined by a lateral direction extending outwardly away from the magazine and/or the first side 21 of the firearm (e.g., in the positive x-direction). Further, in various embodiments, the ambidextrous magazine release assembly 200 may further comprise a rod spring 231 extending along the length of the rod 230 (e.g., in the x-direction) between an interior surface of the first magazine release button 220 and a portion of the body 20 (shown in FIG. 1) defining an opening through which the rod 230 extends adjacent to the rod base 232 aligned therewith. In various embodiments, the rod spring 231 may be configured to apply a force to the first magazine release button 220 away from first side 21 and the rod spring 231 may urge the rod base 232 towards the second side 22 via a pulling force from the rod 230 on the base 232 (e.g., based at least in part on the engagement of rod spring 231 with a body wall portion 23 of the body 20 as shown in FIG. 8B).

In various embodiments, the ambidextrous magazine release button 211 may be operable from the first side 21 of the firearm such that a user of the firearm may access the ambidextrous magazine release button 211 from the first side 21 of the firearm and press the ambidextrous magazine release button 211 in an inward direction (e.g., at least partially in the negative x-direction) into the first side 21 (e.g., left side) of the firearm (e.g., into a recess defined at least partially by the lips 21*a*, 21*c* shown and described with respect to FIG. 2). As illustrated, the ambidextrous magazine release button 211 may be positioned at a first end 210*a* of the lever arm 210 such that the magazine engagement protrusion 212 at the second end 210*b* is arranged on an opposite side of the vertical hinge pivot 213 relative to the ambidextrous magazine release button 211. In such an exemplary configuration, an actuation of the ambidextrous magazine release button 211 may rotate the lever arm 210 in a second lever arm rotational direction towards the disengaged position, rotating the magazine engagement protrusion 212 out of engagement with the magazine. For example, the rotation of the lever arm 210 in the second lever arm rotational direction towards the disengaged position may be defined at least in part by the magazine engagement protrusion 212 to moving in a rotational magazine release direction away from the magazine engaged therewith along an arc defined by the radius of the lever arm 210 from the magazine engagement protrusion 212 to the lever arm hinge orifice 201*a*. In some embodiments, the ambidextrous magazine release assembly 200 may be configured such that, upon actuation of the ambidextrous magazine release button 211, the lever arm 210 rotates about the vertical hinge pivot 213 in the second lever arm rotational direction such that the magazine engagement protrusion 212 is moved in the rotational magazine release direction without causing the rod 230, the rod base 232, and/or the first magazine release button 220 to be moved (e.g., the rod 230, the rod base 232, and/or the first magazine release button 220 remain stationary). In some embodiments, actuation of the ambidextrous magazine release button 211 may not require nor prohibit movement of the first magazine release button 220.

In various embodiments, the ambidextrous magazine release button 211 may be operable from the first side 21 of the firearm such that a user of the firearm may access the ambidextrous magazine release button 211 from the first side 21 of the firearm and press the ambidextrous magazine release button 211 in an inward direction (e.g., at least partially in the negative x-direction) into the first side 21 (e.g., left side) of the firearm. As illustrated, the ambidextrous magazine release button 211 may be positioned at a first end 210*a* of the lever arm 210 such that the magazine engagement protrusion 212 at the second end 210*b* is arranged on an opposite side of the vertical hinge pivot 213 relative to the ambidextrous magazine release button 211. In such an exemplary configuration, an actuation of the ambidextrous magazine release button 211 may impart a non-lateral torque and moment on the lever arm 210 that causes the lever arm 210 to rotate in a second lever arm rotational direction towards a disengaged position. For example, the rotation of the lever arm 210 in the second lever arm rotational direction towards the disengaged position may be defined at least in part by the magazine engagement protrusion 212 to moving in a rotational magazine release direction away from the magazine engaged therewith. In such an exemplary circumstance, the ambidextrous magazine release assembly 200 may be configured such that, upon actuation of the ambidextrous magazine release button 211, the lever arm 210 rotates about the vertical hinge pivot 213 in the second lever arm rotational direction such that the magazine engagement protrusion 212 is moved in the rotational magazine release direction without causing the rod 230 and/or the first magazine release button 220 to be moved. Further, the lever arm spring 240 may be configured to bias the ambidextrous magazine release button 211 away from the rod base 232 such that when the ambidextrous magazine release button 211 is no longer being actuated (e.g., pressed), the ambidextrous magazine release button 211 may return to a neutral position wherein the ambidextrous magazine release button 211 is at least partially flush and/or aligned with one or more surfaces of the first side 21 of the firearm (e.g., in the position shown in FIGS. 1-2).

Further, in various embodiments, the first magazine release button 220 may be operable from the second side 22 of the firearm such that a user of the firearm may access the first magazine release button 220 from the second side 22 of the firearm and press the first magazine release button 220 in an inward direction (e.g., at least partially in the positive x-direction) into the second side 22 (e.g., into a recess defined in the right side) of the firearm. As illustrated, the first magazine release button 220 may be positioned at a first end 230*a* of the rod 230, and a rod spring 231 may be configured to surround at least a portion of the rod 230 between an internal surface of the first magazine release button 220 and a portion of the body 20 defining an opening leading to the rod base 232. In such an exemplary configuration, an actuation of the first magazine release button 220 may be embodied by a user pressing the first magazine release button 220 inward from the second side 22 of the firearm in a lateral direction towards the rod base 232, which may cause the rod spring 231 to compress along the length of the rod 230 against the body 20 while translating the rod body 232 outwardly. The compression of the rod spring 231 may result in a spring force embodied by at least substantially equal and opposite pushing forces imparted on the first magazine release button 220 in the negative x-direction and the rod base 232 in the positive x-direction, as illustrated. In various embodiments, movement of the first magazine release button 220 inwardly into the second side 22 towards the first side 21 may cause the rod base 232 to move in a lateral direction away from the rod spring 231 and away from the body 20 (e.g., in the positive x-direction). In various embodiments, the movement of the rod base 232 caused by the actuation of the first magazine release button 220 results in the lever arm 210 exhibiting an at least substantially similar lateral, translational movement in an outward direction (e.g., in the positive x-direction) away from the first side 21 of the firearm. For example, the ambidextrous magazine release assembly 200 may be configured such that, upon actuation of the first magazine release button 220, the lever arm 210, including the magazine engagement protrusion 212 and the ambidextrous magazine release button 211, may be laterally translated with the rod base 232 so as to be pushed outward from the first side 21 of the firearm (e.g., in a lateral direction that is at least substantially along a central axis of the rod 230) towards a disengaged position. In particular, such a lateral movement of the lever arm 210 caused by an actuation of the first magazine release button 220 may result in the magazine engagement protrusion 212 being moved in a lateral magazine release direction so as to disengage the magazine without the lever arm 210 being rotated about the vertical hinge pivot 213 (e.g., the "disengaged position" may be two different positions of the lever arm 210, one rotational and one translational, both of which disengage the magazine engagement protrusion 212 from the magazine).

Figure 8A:
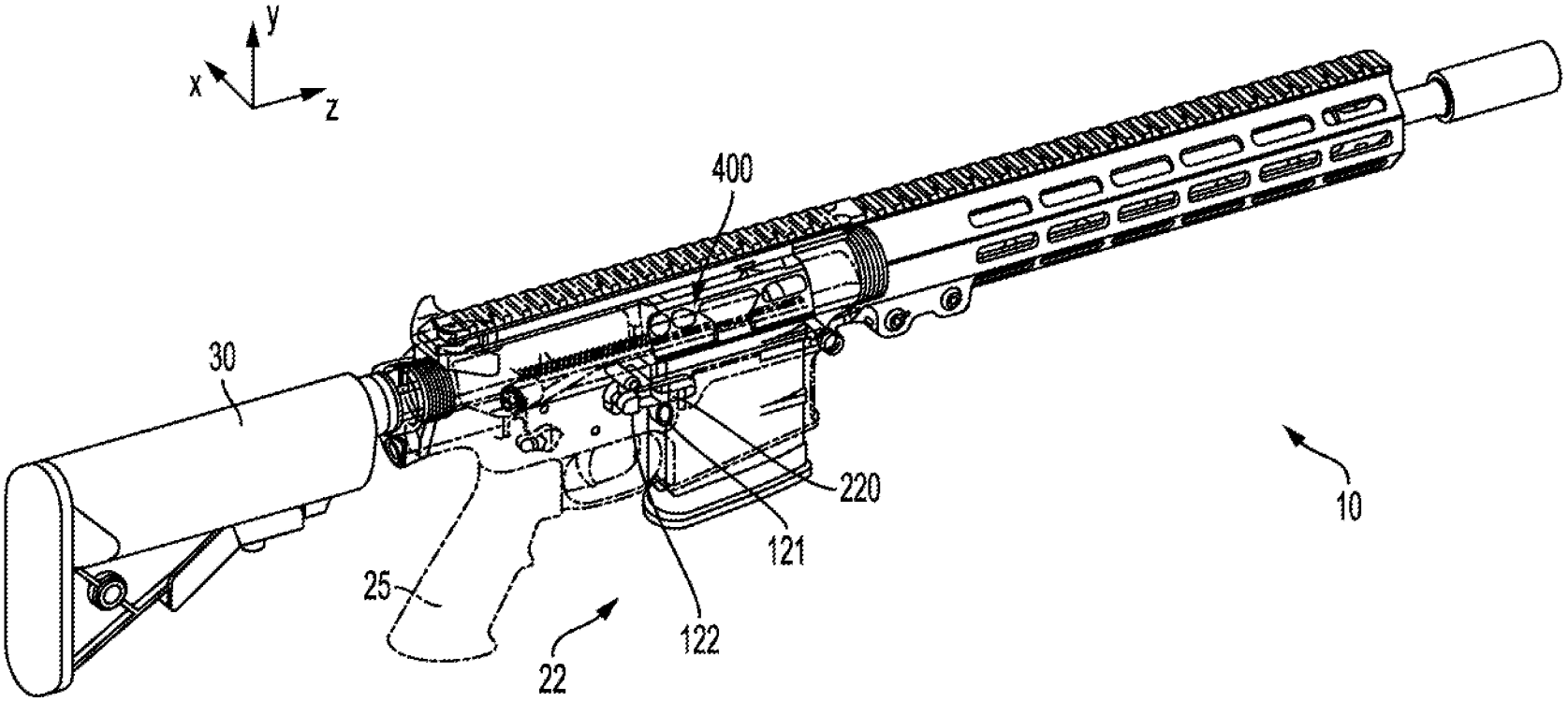
FIGS. 8A-8B illustrate various views of an exemplary rifle having a dust cover and ambidextrous controls in accordance with various embodiments.
Figure 8B:
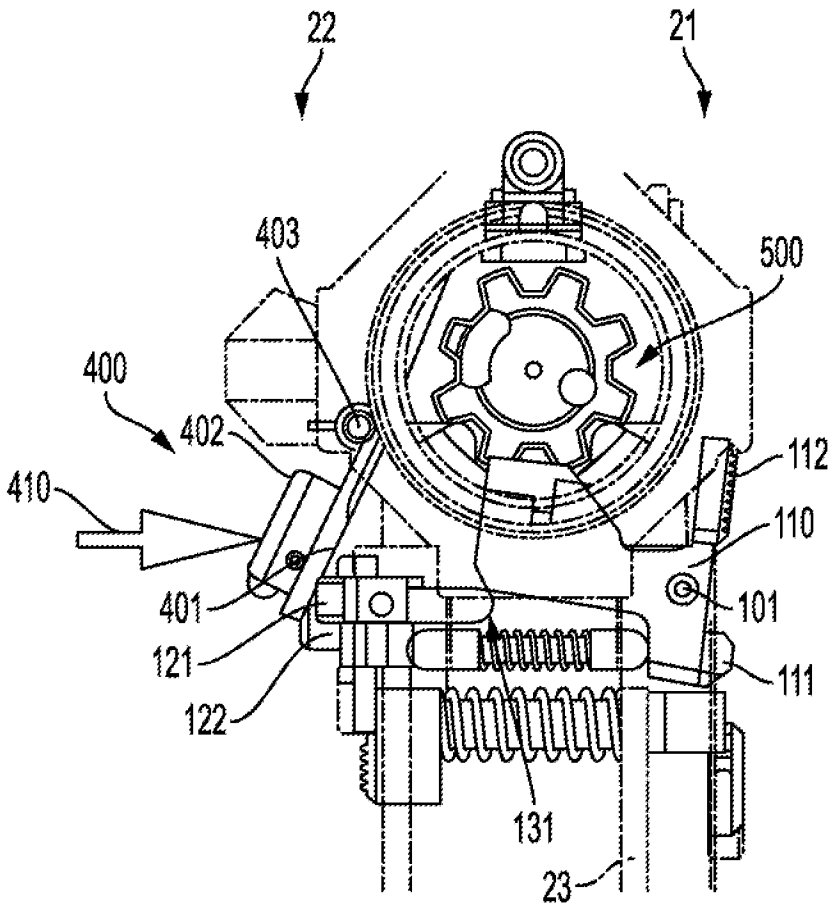

FIGS. 8A-8B illustrate various views of an exemplary firearm including ambidextrous firearm controls in accordance with various embodiments of the present disclosure. In particular, FIGS. 8A and 8B illustrate a perspective view and a front view, respectively, of an exemplary firearm 10 comprising ambidextrous firearm controls including an ambidextrous bolt catch assembly 100 configured for selective engagement with bolt 500 and an exemplary dust cover 400 configured to facilitate actuation of one or more buttons of the ambidextrous bolt catch assembly 100. In various embodiments, an exemplary firearm 10 may comprise a dust cover 400 positioned along an exterior portion of the firearm 10 (e.g., attached to an upper receiver as shown in FIGS. 8A-8B) and configured to cover one or more orifices, openings, windows, and/or the like in the firearm 10 so as to at least partially isolate an internal portion of the firearm from various contaminants in the ambient environment. In operation, the dust cover 400 may open to eject cartridge casings from the upper receiver during a cycling operation.

In various embodiments, the dust cover 400 may have a length that extends in an at least substantially longitudinal direction along the length of the firearm 10 (e.g., in the z-direction) along the second side 22 of the firearm 10 at least partially corresponding to a size of the ejection port in the upper receiver. Further, as illustrated, the dust cover 400 may be arranged along the second side of the firearm in a vertically stacked configuration above the ambidextrous bolt catch engagement button 121. In operation, the user may push the open dust cover against the ambidextrous bolt catch engagement button 121 to depress the ambidextrous bolt catch engagement button 121.

In various embodiments, a dust cover 400 may be hingedly connected to the firearm 10 about a dust cover hinge pivot 403 extending in a longitudinal direction (e.g., along the length of the firearm in the z-direction) such that the dust cover 400 is configurable between a closed position and an open position. As illustrated, the dust cover 400 may comprise an internal dust cover surface 402 and an external dust cover surface 401. For example, in an exemplary circumstance wherein the dust cover 400 is arranged in the closed position, the external dust cover surface 401 defines an exterior surface of the firearm 10 and the internal dust cover surface 402 defines an inward-facing, interior surface of the firearm 10. Further, when the dust cover 400 is arranged in an open position, as illustrated in FIG. 8B, the external dust cover surface 401 may rotate about the hinge pivot 403 to engage the ambidextrous bolt catch engagement button 121 arranged on the second side 22 of the firearm. In various embodiments, an exemplary dust cover 400 may be used to actuate the ambidextrous bolt catch engagement button 121. For example, the dust cover 400 may be configured such that, in an instance in which the dust cover 400 is moved in an opening direction towards the open position, at least a portion of an exterior surface of the dust cover 400 engages the ambidextrous bolt catch engagement button 121 to facilitate actuation of the ambidextrous bolt catch engagement button 121 by applying a pushing force 410 at an interior surface 402 of the dust cover 400. As shown, the pressing force 410 may be applied to the internal dust cover surface 402, so as to impart a corresponding pushing force on the ambidextrous bolt catch engagement button 121 in an at least substantially inward lateral direction from the second side 22 of the firearm (e.g., in the positive x-direction). Further, in various embodiments, the dust cover 400 may be positioned to be movable from the closed position towards the open position without engaging the ambidextrous bolt catch release button 122. In some embodiments, the dust cover 400 may be spring loaded (e.g., via a spring wrapped around the hinge pivot 403 to force the dust cover open. In some embodiments, the automatic opening of the dust cover 400 may be insufficient to actuate the ambidextrous bolt catch engagement button 121 without further manual force applied by the user. With reference to FIGS. 3 and 8A, in some embodiments, the portion of the perimeters of the ambidextrous bolt catch engagement button 121 and the ambidextrous bolt catch release button 122 that are adjacent one another may match or substantially match a corresponding shape of a portion of the outer perimeter of the dust cover, such that the dust cover is able to depress the ambidextrous bolt catch engagement button 121 without impinging any portion of the ambidextrous bolt catch release button 122.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An ambidextrous bolt catch assembly comprising:

a bolt catch configured to hingedly connect to a firearm to rotate between a disengaged position and an engaged position, the bolt catch comprising a first bolt catch engagement button operable from a first side of the firearm and a first bolt catch release button operable from the first side of the firearm, wherein the first bolt catch engagement button is configured to, upon actuation thereof, cause the bolt catch to rotate in a first rotational direction towards the engaged position, and wherein the first bolt catch release button is configured to, upon actuation thereof, cause the bolt catch to rotate in a second rotational direction towards the disengaged position;

an ambidextrous bolt catch engagement button operable from a second side of the firearm and configured to, upon actuation thereof, cause the bolt catch to move in the first rotational direction; and an ambidextrous bolt catch release button operable from the second side of the firearm and configured to, upon actuation thereof, cause the bolt catch to move in the second rotational direction;

wherein the ambidextrous bolt catch engagement button and the ambidextrous bolt catch release button are each separately movable relative to the firearm.

2. The ambidextrous bolt catch assembly of claim 1, wherein the ambidextrous bolt catch engagement button is configured to cause the bolt catch to move in the first rotational direction by, upon actuation thereof, causing a first pushing element to move laterally toward the first side of the firearm and engage the bolt catch so as to exert a pushing force on the bolt catch and cause the bolt catch to rotate in the first rotational direction.

3. The ambidextrous bolt catch assembly of claim 2, wherein the bolt catch further comprises an angled engagement interface oriented at least partially downwardly and at least partially towards a second side of the firearm; and wherein the first pushing element is configured to, upon actuation of the ambidextrous bolt catch engagement button, engage the bolt catch at the angled engagement interface so as to exert the pushing force on the angled engagement interface.

4. The ambidextrous bolt catch assembly of claim 1, wherein the ambidextrous bolt catch release button is configured to cause the bolt catch to move in the second rotational direction by, upon actuation thereof, causing a second pushing element to move laterally toward the first side of the firearm and engage the bolt catch so as to exert a pushing force on the bolt catch and cause the bolt catch to rotate in the second rotational direction.

5. The ambidextrous bolt catch assembly of claim 4, wherein the bolt catch further comprises a third pushing element configured to contact the bolt catch and arranged such that in an instance in which the bolt catch is in the disengaged position, the third pushing element extends in an at least substantially lateral direction towards the second side of the firearm.

6. The ambidextrous bolt catch assembly of claim 5, wherein the second pushing element is configured to, upon actuation of the ambidextrous bolt catch release button, engage the bolt catch at the third pushing element so as to exert the pushing force on the third pushing element, wherein the third pushing element is positioned to engage a surface of the bolt catch and cause the bolt catch to rotate in the second rotational direction.

7. The ambidextrous bolt catch assembly device of claim 6, wherein the first bolt catch engagement button is disposed at an end portion of an arm of the bolt catch; and wherein the surface of the bolt catch defines at least a portion of the arm of the bolt catch, the surface being arranged on an opposing side of the arm relative to the first bolt catch engagement button.

8. The ambidextrous bolt catch assembly of claim 5, wherein the ambidextrous bolt catch assembly is configured such that in an instance in which the bolt catch is in the disengaged position, the third pushing element is at least substantially coaxial with the second pushing element and separated from the second pushing element by a lateral gap extending therebetween the second pushing element and the third pushing element, wherein a spring is disposed between the second pushing element and the third pushing element.

9. The ambidextrous bolt catch assembly of claim 8, wherein the lateral gap defines a distance such that, in an instance in which the ambidextrous bolt catch release button is in a neutral position, the bolt catch is configured to rotate to the engaged position in response to actuation of the first bolt catch engagement button without the second pushing element contacting the third pushing element.

10. The ambidextrous bolt catch assembly of claim 1, wherein the ambidextrous bolt catch engagement button and the ambidextrous bolt catch release button are each hinged about a common axis extending in an at least substantially vertical direction.

11. The ambidextrous bolt catch assembly of claim 1, wherein the ambidextrous bolt catch engagement button and the ambidextrous bolt catch release button are arranged in a vertically stacked configuration; wherein the ambidextrous bolt catch release button is longer than the ambidextrous bolt catch engagement button and at least a portion of the ambidextrous bolt catch release button wraps around at least a portion of a distal end of the ambidextrous bolt catch engagement button such that both the ambidextrous bolt catch release button and the ambidextrous bolt catch engagement button are operable from a common vertical position along a height of the firearm.

12. The ambidextrous bolt catch assembly of claim 1, further comprising an ambidextrous magazine release assembly, the ambidextrous magazine release assembly comprising:

a rod extending from a first rod end to a second rod end, wherein the rod is positioned in an at least substantially lateral direction between the first side of the firearm and the second side of the firearm, the second rod end being defined by a rod base;

a lever arm extending from a first arm end to a second arm end and being positioned in an at least substantially longitudinal direction along the first side of the firearm, wherein the lever arm is configured to hingedly connect to the rod base, the lever arm comprising:

a magazine engagement protrusion extending from the second arm end, the magazine engagement protrusion being configured to engage a magazine in an engaged position; and an ambidextrous magazine release button positioned at the first arm end, the ambidextrous magazine release button being operable from the first side of the firearm and configured to, upon actuation thereof, cause the magazine engagement protrusion to move in a rotational magazine release direction;

wherein the lever arm is hingedly connected to the rod base at a vertical hinge pivot positioned along the lever arm between the magazine engagement protrusion and the ambidextrous magazine release button;

a first magazine release button connected to the first rod end, the first magazine release button being operable from the second side of the firearm and configured to, upon actuation thereof, cause the magazine engagement protrusion to move in a lateral magazine release direction;

a rod spring positioned between the first magazine release button and a portion of a lower receiver adjacent to the rod base and configured to bias the first magazine release button outwardly away from the first side; and a lever arm spring extending between the ambidextrous magazine release button and the rod base and configured to rotationally bias the ambidextrous magazine release button about the vertical hinge pivot and away from the rod base so as to bias the magazine engagement protrusion towards the magazine.

13. The ambidextrous bolt catch assembly of claim 12, wherein the ambidextrous magazine release assembly is configured such that, upon actuation of the ambidextrous magazine release button, the lever arm rotates about the vertical hinge pivot without causing the rod to move.

14. The ambidextrous bolt catch assembly of claim 12, wherein the ambidextrous magazine release assembly is configured such that, upon actuation of the first magazine release button, the rod base and the lever arm translate in an outward lateral direction away from the first side of the firearm without rotating about the vertical hinge pivot.

15. The ambidextrous bolt catch assembly of claim 12, wherein the first side of the firearm comprises at least one raised lip element protruding in an outward lateral direction away from the first side of the firearm, the at least one raised lip element being configured to extend at least partially around a perimeter of the ambidextrous magazine release button.

16. The ambidextrous bolt catch assembly of claim 12, wherein each of the first bolt catch engagement button, the first bolt catch release button, and the ambidextrous magazine release button are aligned in a vertically stacked configuration along the first side.

17. The ambidextrous bolt catch assembly of claim 1, further comprising a dust cover configured to hingedly connect to the second side of the firearm to move between an open position and a closed position, wherein the dust cover is configured such that, in an instance in which the dust cover is moved in an opening direction towards the open position, at least a portion of an exterior surface of the dust cover engages the ambidextrous bolt catch engagement button to facilitate actuation of the ambidextrous bolt catch engagement button.

18. The ambidextrous bolt catch assembly of claim 17, wherein the dust cover is positioned to be movable from the closed position towards the open position without engaging the ambidextrous bolt catch release button.

19. A firearm comprising the ambidextrous bolt catch assembly of claim 1.

20. An ambidextrous bolt catch assembly comprising:

a bolt catch configured to hingedly connect to a firearm to rotate between a disengaged position and an engaged position, the bolt catch comprising:

a protrusion configured to engage a bolt of the firearm; and an angled engagement interface oriented at least partially downwardly and at least partially towards a second side of the firearm;

a first bolt catch engagement button operable from a first side of the firearm configured to, upon actuation thereof, cause the bolt catch to rotate in a first rotational direction towards the engaged position; and an ambidextrous bolt catch engagement button operable from a second side of the firearm and configured to, upon actuation thereof, cause a first pushing element to move laterally toward the first side of the firearm and engage the angled engagement interface of the bolt catch to cause the bolt catch to rotate in the first rotational direction towards the engaged position.

21. The ambidextrous bolt catch assembly of claim 20, further comprising an ambidextrous bolt catch release button operable from the second side of the firearm and configured to, upon actuation thereof, cause the bolt catch to move in a second rotational direction to the disengaged position, wherein the ambidextrous bolt catch release button causes the bolt catch to move in the second rotational direction by, upon actuation thereof, causing a second pushing element to move laterally toward the first side of the firearm and engage the bolt catch so as to exert a pushing force on the bolt catch and cause the bolt catch to rotate in the second rotational direction.

22. The ambidextrous bolt catch assembly of claim 20, wherein the angled engagement interface comprises an interface angle of at least approximately 45 degrees.

23. A firearm comprising the ambidextrous bolt catch assembly of claim 20.

* * * * *